United States Patent [19]

Cover et al.

[11] 4,034,472

[45] July 12, 1977

[54] WIRE TERMINATION APPARATUS

[75] Inventors: William S. Cover, Glendale Heights; Jacob S. Haller, Northbrook; James R. Quigley, Lombard, all of Ill.

[73] Assignee: TRW Inc., Elk Grove Village, Ill.

[21] Appl. No.: 576,148

[22] Filed: May 9, 1975

[51] Int. Cl.[2] ..... H01R 43/04

[52] U.S. Cl. ..... 29/749; 29/753

[58] Field of Search ..... 29/203 MW, 203 P, 203 J, 29/203 H, 203 HT, 203 DT, 628, 749, 753, 751

[56] References Cited

U.S. PATENT DOCUMENTS

| | | | |
|---|---|---|---|
| 3,101,765 | 8/1963 | Butcheller | 29/203 DT |
| 3,168,750 | 2/1965 | Gattiker, Jr. | 7/14.1 R |
| 3,216,096 | 11/1965 | Rayburn | 29/203 R |
| 3,406,247 | 10/1968 | Parsons | 174/88 |
| 3,438,407 | 4/1969 | Over | 140/111 |
| 3,456,325 | 7/1969 | Langlois et al. | 29/203 D |
| 3,509,615 | 5/1970 | Jackson | 29/203 D |
| 3,571,890 | 3/1971 | Brehm et al. | 29/203 D |
| 3,587,158 | 6/1971 | Sullivan | 29/203 P |
| 3,594,900 | 7/1971 | Dola et al. | 29/628 |
| 3,611,782 | 10/1971 | Eppler | 72/410 |
| 3,628,202 | 12/1971 | Brown et al. | 7/14.1 |
| 3,707,756 | 1/1973 | Wolyn | 29/203 DT |
| 3,742,571 | 7/1973 | Brehm | 29/203 H |
| 3,766,622 | 10/1973 | Brehm et al. | 29/203 MW |
| 3,800,390 | 4/1974 | Johnston | 29/203 MW |
| 3,838,491 | 10/1974 | Mayberry et al. | 29/203 H |
| 3,968,555 | 7/1976 | Holt | 29/203 MW |

*Primary Examiner*—Carl E. Hall
*Attorney, Agent, or Firm*—Neuman, Williams, Anderson & Olson

[57] ABSTRACT

A machine for semi-automatically trimming insulated conductor wires and inserting the trimmed wires into solderless terminals in connectors for effecting solderless conductive termination of the wires therein, with positioning control of the wires during prepositioning beside the connector and subsequent severance and transference into the terminals of the connector. The machine is capable of effecting such terminations in a variety of connectors.

34 Claims, 41 Drawing Figures

FIG. 11A
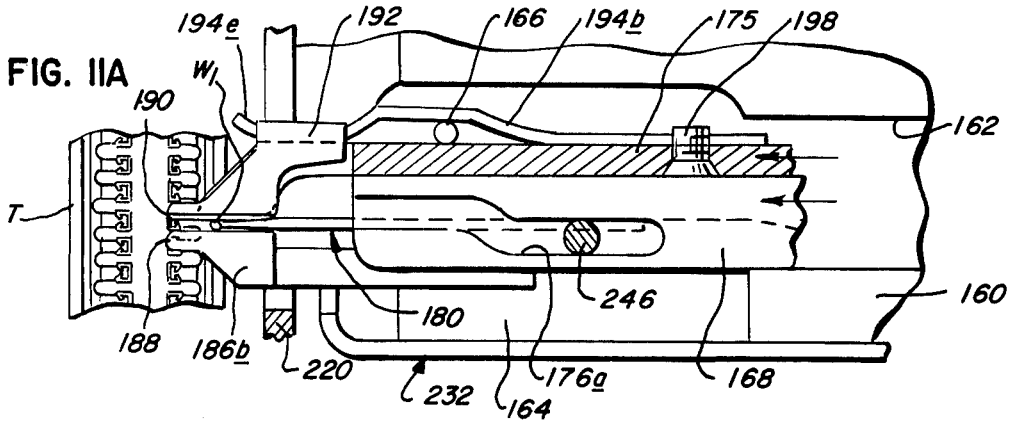
FIG. 12A
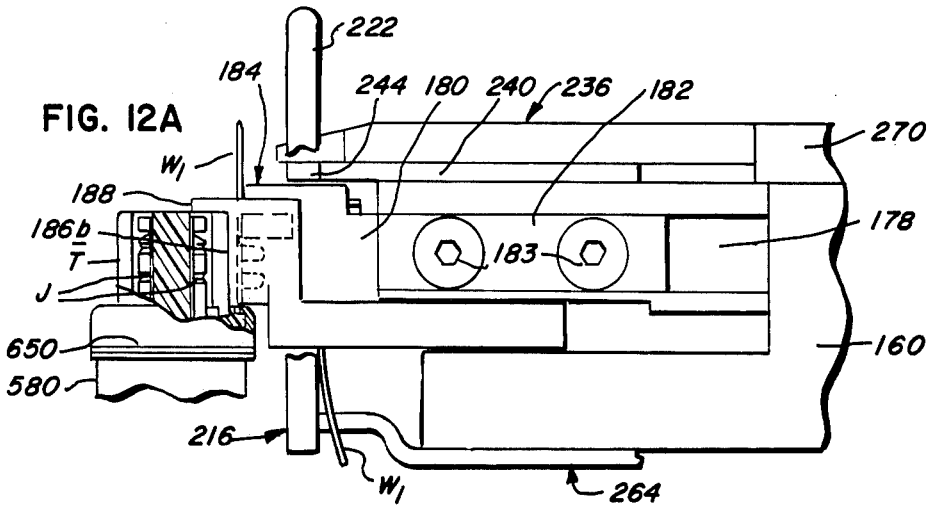
FIG. 11B
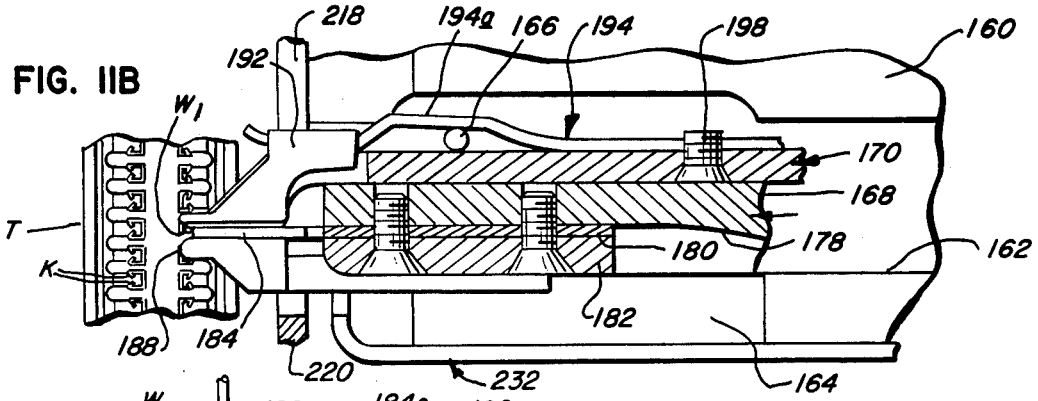
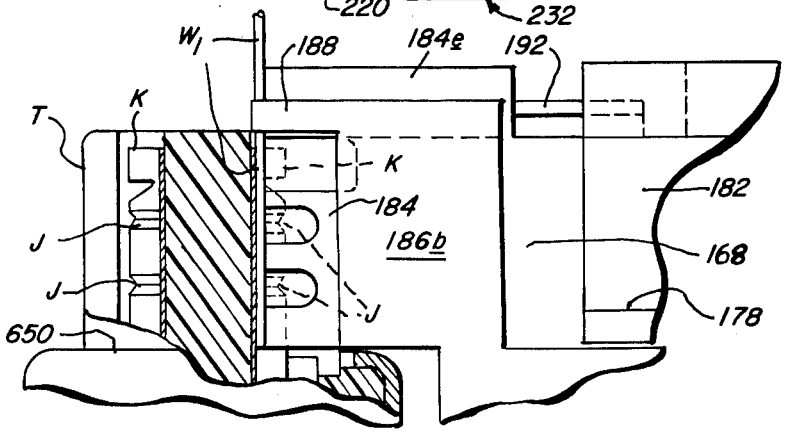
FIG. 12B

FIG. 18A
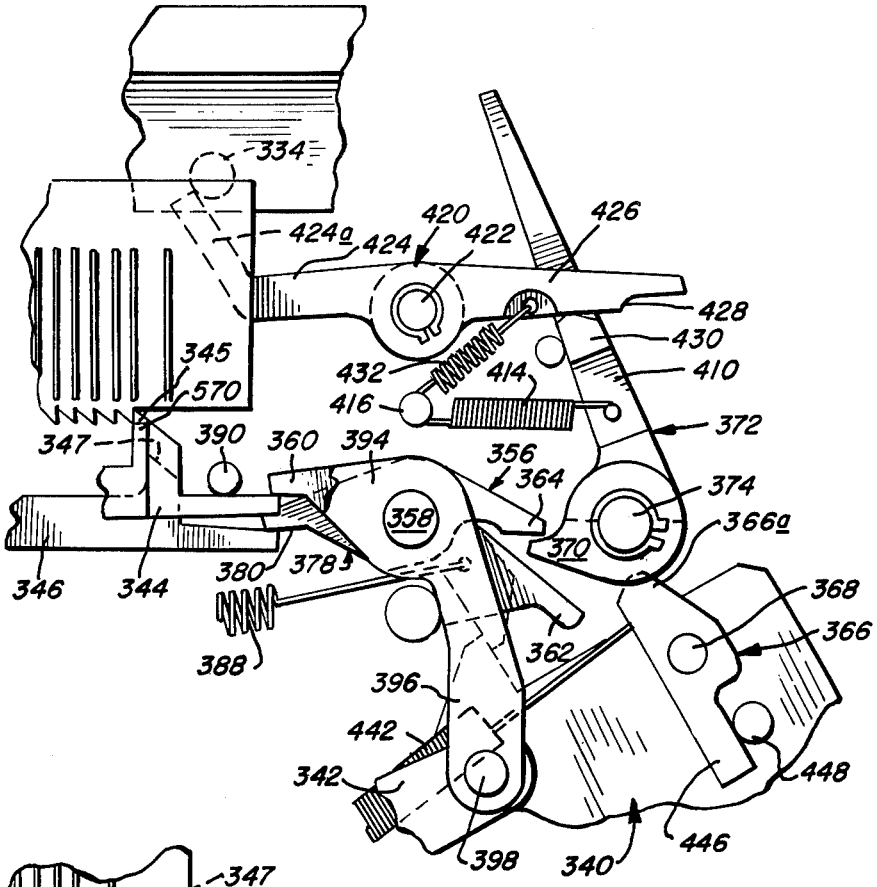
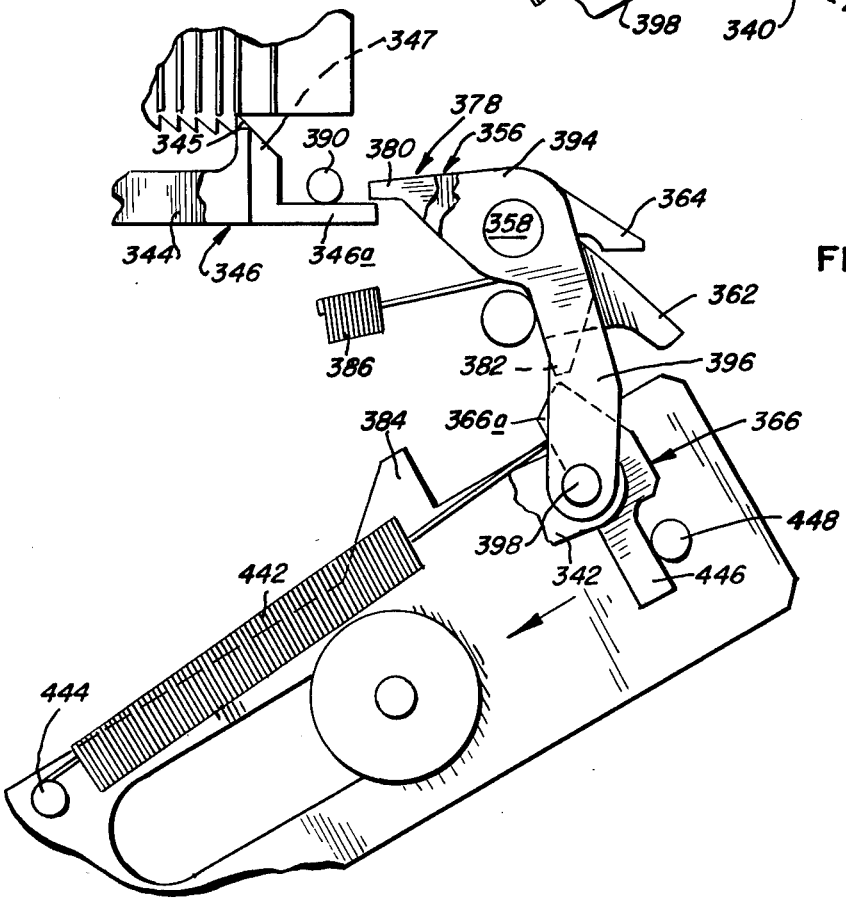
FIG. 18B

WIRE TERMINATION APPARATUS

The machine shown and described herein as a preferred embodiment or best mode of the present invention incorporates related preceding improvements and features provided by William S. Cover and Jacob I. Haller and which are claimed in application Ser. No.. 576,192 filed herewith, as well as further improvements and features provided by others.

This invention relates to apparatus for terminating conductor wires in connectors, and more specifically to apparatus for terminating a succession of wires in a series of solderless terminals of a connector wherein the wires are forced into the terminals in a manner to effect the terminations.

In recent years numerous forms of solderless connectors have been developed. By way of example these include improved multi-terminal connectors of TRW Inc. employing improved terminals such as illustrated in part in the drawings herein, and disclosed more fully in copending application Ser. No. 443,678 of William H. McKee and Roy Witte filed Feb. 19, 1974, and Ser. No. 443,730 of William H. McKee also filed Feb. 19, 1974, now U.S. Pat. No. 3,902,154. In conjunction with the developments in connectors of the indicated type, various devices and machines have been proposed for inserting wires in such connectors. One example of such a prior device which relates to certain elements of the machine disclosed herein is the apparatus disclosed in copending application Ser. No. 502,086 of William H. McKee filed Aug. 30, 1974, now U.S. Pat. No. 3,997,956. Another example is the improvements claimed in the Cover and Haller applications referred to above. A variety of other tools and machines have been proposed by others for effecting similar terminations.

It is an object of this invention to provide improved wire insertion apparatus.

It is a more particular object of this invention to provide an improved semi-automatic wire terminating machine in which the wires are accurately controlled in their placement in a pretermination orientation and position as well as through their severance and subsequent transfer to and insertion into laterally open solderless terminals in connectors. It is a more specific object to provide such improvements in a machine wherein each wire is accurately oriented during prepositioning and then is severed at a position substantially spaced from the ultimate termination position, and to maintain positive control over the orientation of the insertion portion of the trimmed wire during its transference from the remote severance position into the terminal and through the termination operation. Attainment of these objects permits trimming and termination of wires accurately and with a high degree of both mechanical and electrical contact reliability in connectors of a variety of designs.

It is another object of this invention to provide wire termination apparatus which will terminate conductor wires in solderless connectors of a variety of configurations, and specifically to provide such a machine which is capable of uniformly trimming the wires and effecting reliable uniform terminations in connectors of various designs as made by different manufacturers.

Further and additional objects and advantages will appear from the following description and accompanying drawings describing and illustrating a machine employing the teachings of this invention, and from the appended claims. As noted above, the machine shown and described herein includes improvements and features provided by others. Such improvements and features are included as part of describing a preferred machine employing this invention. The improvements and features of this invention are particularly pointed out in the appended claims.

In carrying out this invention in one illustrative form, a machine is provided for successively terminating individual conductor wires of a group of such wires in separate laterally open parallel terminals distributed along the length of a connector by movement of each wire along a first path generally transversely of its longitudinal axis into the respective terminal of the connector. Means are provided for holding the connector and for clamping a group of wires adjacent one end of the top or terminal portion of the connector. Wire locating stops are disposed opposite the open sides of the terminals of a connector on the holder for engaging and positioning a portion of a wire extending from the clamp as the wire is moved along the connector in a direction transverse to the terminal openings. The stops are located to orient a wire portion positioned thereagainst in a first position on the wire termination path in spaced relation to the connector and with the longitudinal axis of the wire portion substantially parallel to the axis of the respective terminal. A wire support and transfer means transfers the wire portion from the first position into the respective terminal while maintaining the noted parallel relationship. The wire is trimmed at one end of the designated portion at the beginning of its transfer movement, and also is gripped adjacent an opposite end of the portion to assure proper positioning of the wire axially of its length throughout the transfer and insertion operation. The apparatus thereby permits the transfer and insertion movement to span a significant distance while maintaining a high degree of accuracy and reliability of the terminations, which in turn facilitates the provision of a machine that is adapted to terminating of wires in connectors of a variety of designs. Further, the wire positioning elements are located entirely at the sides of the connector, with the area over the connector remaining unobstructed, whereby the connector and terminated wires may be advanced or retracted relative to the wire stop components at any time during the placement of a series of wires in a connector.

For a more complete understanding of this invention, reference should now be had to the machine illustrated in greater detail in the accompanying drawings and described below by way of an embodiment of the invention.

FIGS. 11, 11A and 11B are enlarged top views of the wire insertion mechanism of FIGS. 6 and 7 in changed positions as a wire is inserted in a connector thereby;

FIGS. 12, 12A and 12B are enlarged front views corresponding to FIGS. 11, 11A and 11B, respectively;

FIGS. 18A–18D illustrate various operating positions of portions of the ratchet mechanism of FIGS. 15 and 16;

Figure 1:
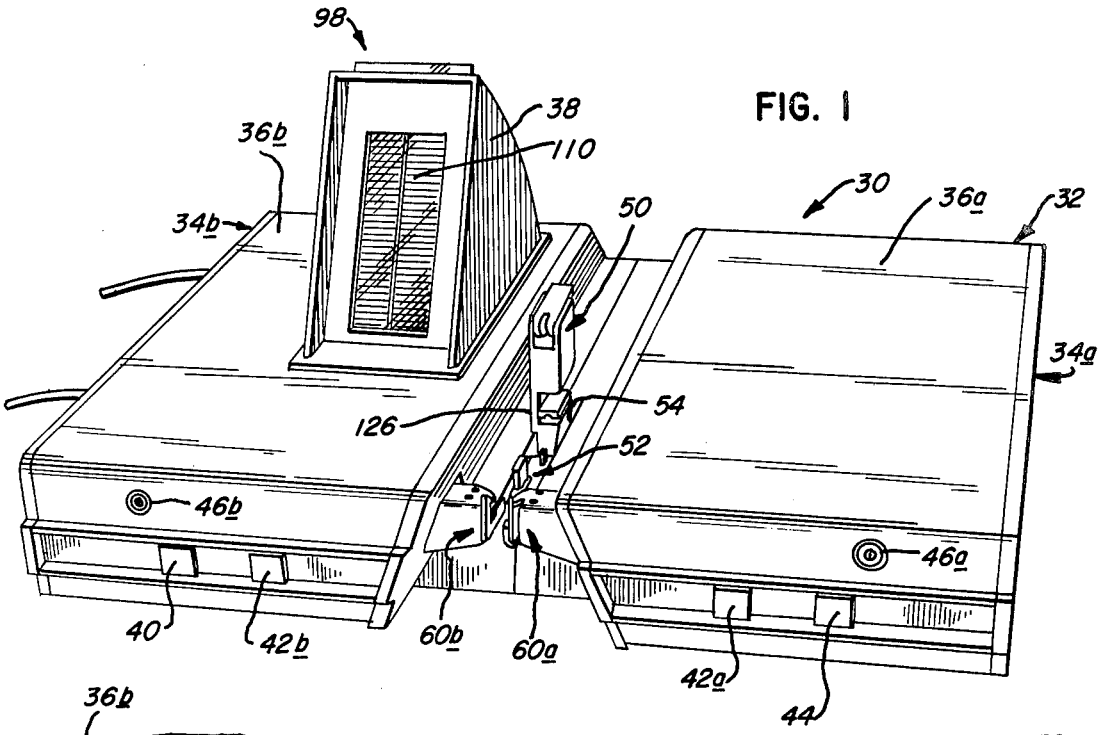
FIG. 1 is a perspective of a machine employing teachings of this invention.

Referring now to the drawings, FIG. 1 illustrates a machine 30 having a housing 32 including a main housing comprising right-hand and left-hand sections 34*a* and 34*b*, and hinged covers 36*a* and 36*b*. A cover 38 for an indicator-type training display accessory, to be described further below, protrudes upwardly through the hinged cover 36*b*. As seen in FIG. 1, the housing is generally symmetrical about a longitudinal center line, with the portions on each side being mirror images of the other. This is generally true also of much of the operating mechanism, as will become apparent with the further description. A control button 40 for an on/off switch, a pair of control buttons 42*a* and 42*b* for spacer controls, and a button 44 for operating a carriage return mechanism, all protrude through the forward face of the machine. Key-operated locks may be provided as at 46*a* and 46*b* for locking the covers 36*a* and 36*b* in closed positions. A cable clamp assembly 50 and means 52 for gripping and holding a connector in which wires are to be terminated project upwardly through an elongated central slot 54 disposed along the longitudinal centerline of the machine. The components 50 and 52 are mounted on a carriage for reciprocating movement along the slot 54, as also will be described further below. Stationary wire trapping assemblies 60*a* and 60*b* are located at each side of the forward end of the slot 54, see FIG. 4.

Figure 4:
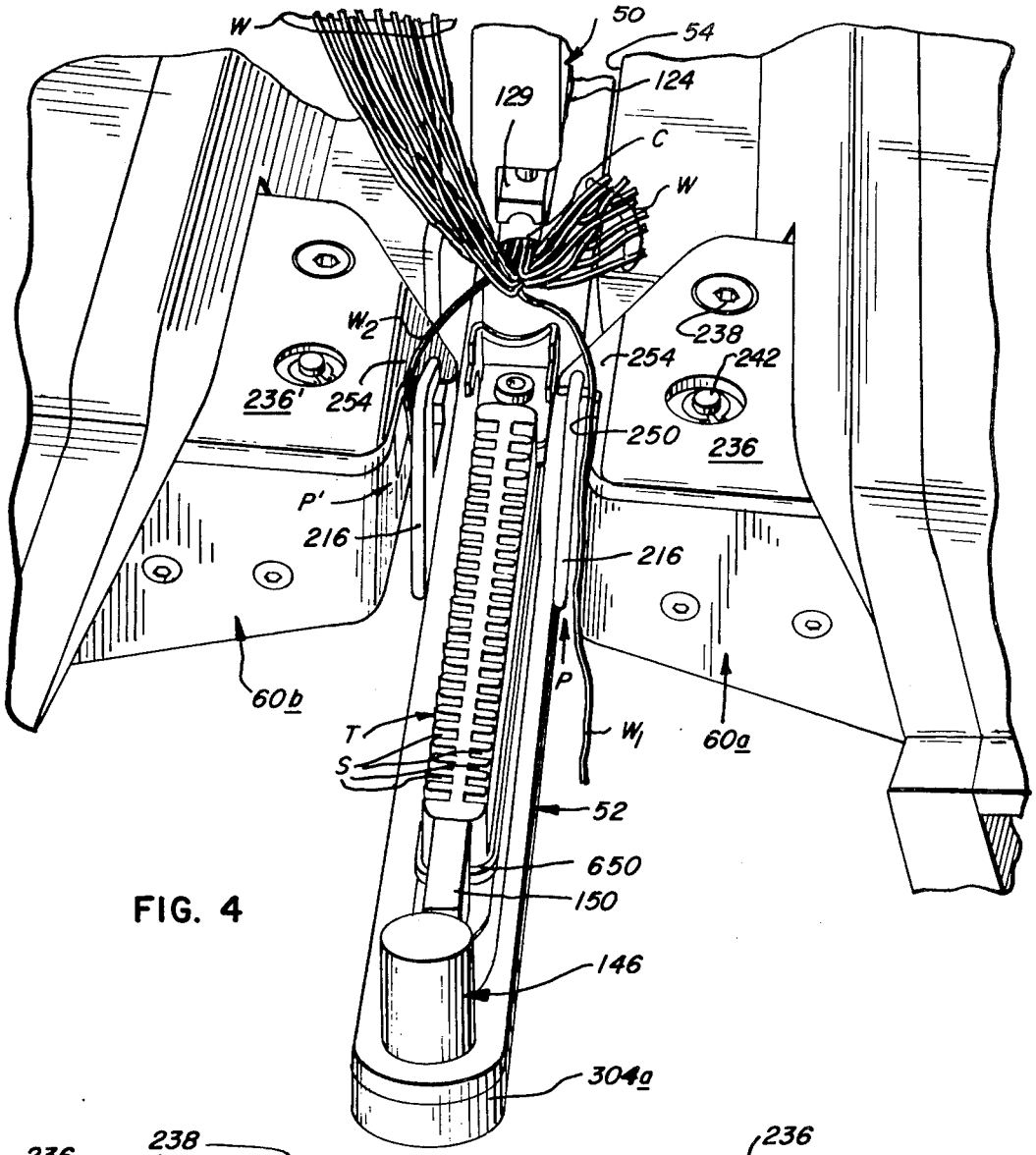
FIG. 4 is a view like FIG. 2, with a cable and a connector in place on the connector carrier and the connector carrier forward, the first pair of wires being in the stop position and the remaining wires "fanned" upward, with part of the wire ends broken away to show the cable clamp head.

As shown in FIG. 4, a sheathed cable C which typically includes multiple pairs of insulated wires W, such as twenty-five pairs of telephone communication wires, may be gripped in the clamp 50. The outer end portion of the sheath has been removed, and the end portions (6–8 inches) of the individual wires have been "fanned" upward. A first pair of wires W1 and W2 are shown dressed downward in the trapping assemblies 60*a* and 60*b*, respectively, preliminary to being terminated in a connector T held by the means 52. The connector T may be of any of a number of specific designs which include rows of adjacent parallel terminals, each of which is designed to effect a so-called "solderless" electrical connection with the conductor of an insulated wire upon insertion of that wire into the respective terminal in a direction generally laterally of the longitudinal axis of the wire. A particular commercial example of such a connector which is shown in certain figures of the drawings herein is sold by TRW Inc. of Cleveland, Ohio under the name "CINCH RIBBON".

By way of a preliminary overview, the termination of wires W in a connector by machine 30 typically is effected by providing for trapping of each of a pair of the wires in precise positions of alignment with an opposed pair of terminals in the connector T, upon a simple locating manipulation of the wires by the operator as at $W_1$ and $W_2$, and then positively maintaining the alignment and relative positioning of those wires as they are trimmed to the appropriate length and transferred laterally to and forcibly inserted into the respective terminals. As will be appreciated by those skilled in the art, the trimming and lateral insertion of wires in solderless terminals generally is old in this art. However, improvements and features embodied in the illustrated machine include positive positioning control of the wires throughout the trimming, transference and insertion operations, and ready universal adaptability of the machine to performing such termination operations in connectors of a wide variety of designs.

Figure 3:
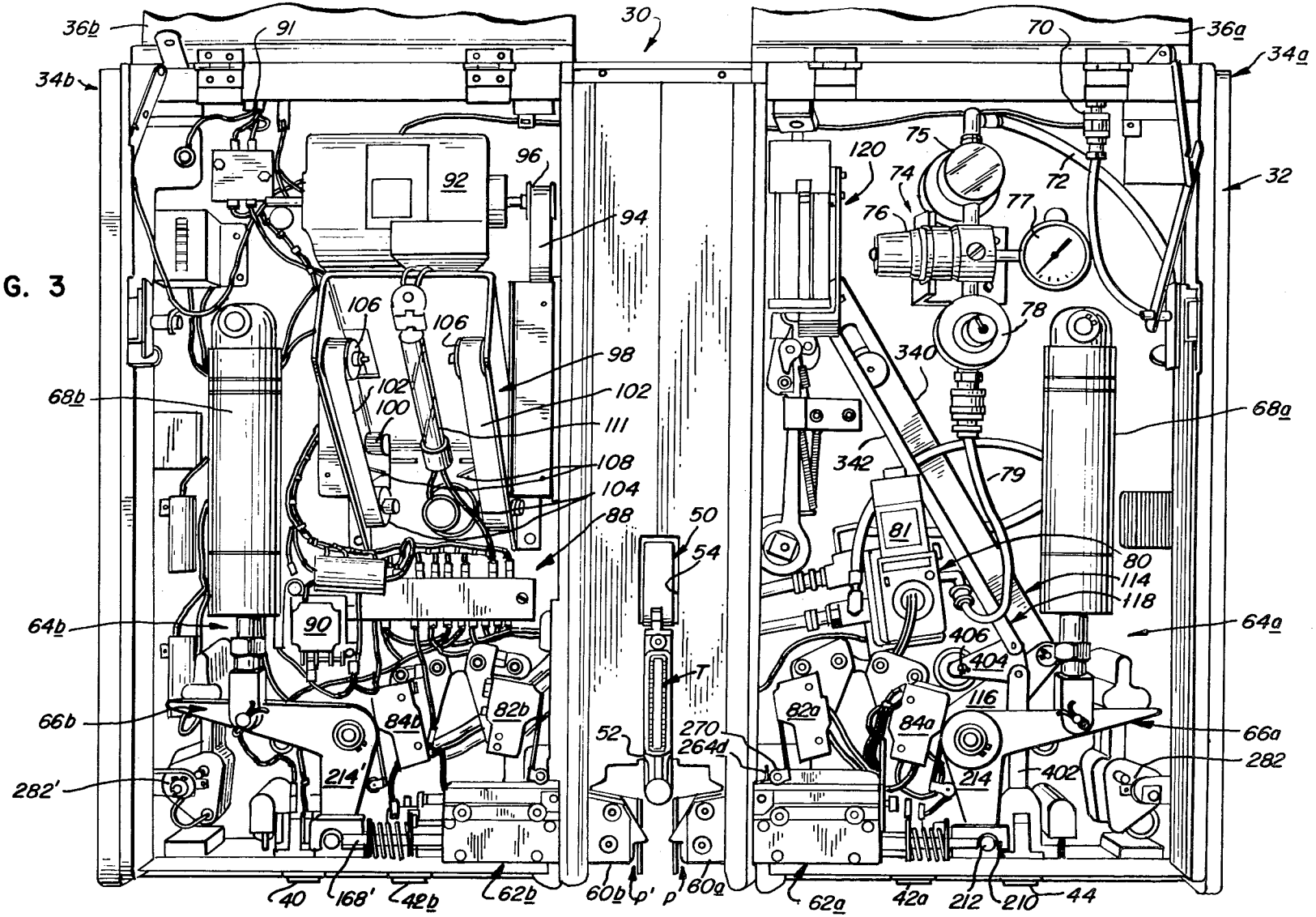
FIG. 3 is a top perspective view of the machine of FIG. 1 with the covers open, and with the cover and index plate removed from the trainer.

Referring now more particularly to FIG. 3, the operating mechanism of the machine 30 includes a pair of insertion assemblies 62*a* and 62*b*, and related drive means 64*a* and 64*b* comprising bell cranks 66*a* and 66*b* and respective pneumatic drive cylinders 68*a* and 68*b*. A connector 70 is provided for connection with an external supply of compressed air, and is connected by a flexible hose 72 to an air control unit 74 comprising a filter 75, a pressure regulator 76, a pressure indicator 77 and a lubricator (fog-type oiler) 78, all of which may be commercially available components. A further flexible hose 79 leads from the air supply unit 74 to a solenoid operated pneumatic controller 80 from which appropriate conduits lead to the respective ends of the cylinders 68*a* and 68*b*. By way of further example, the controller 80 may be a commercially available unit, such as a "Neumatics" controller model No. 227-833B manufactured by Detroit Coil Company. The drive solenoid 81 of the controller 80 is operated in response to the actuation of micro switches 82*a*, 82*b*, 84*a*, and 84*b*, through appropriate circuitry components indicated generally at 88 and including a time delay relay 90, to obtain the operating cycle functions described herein. An electrical power supply connector is indicated at 91.

Figures 13, 13A:
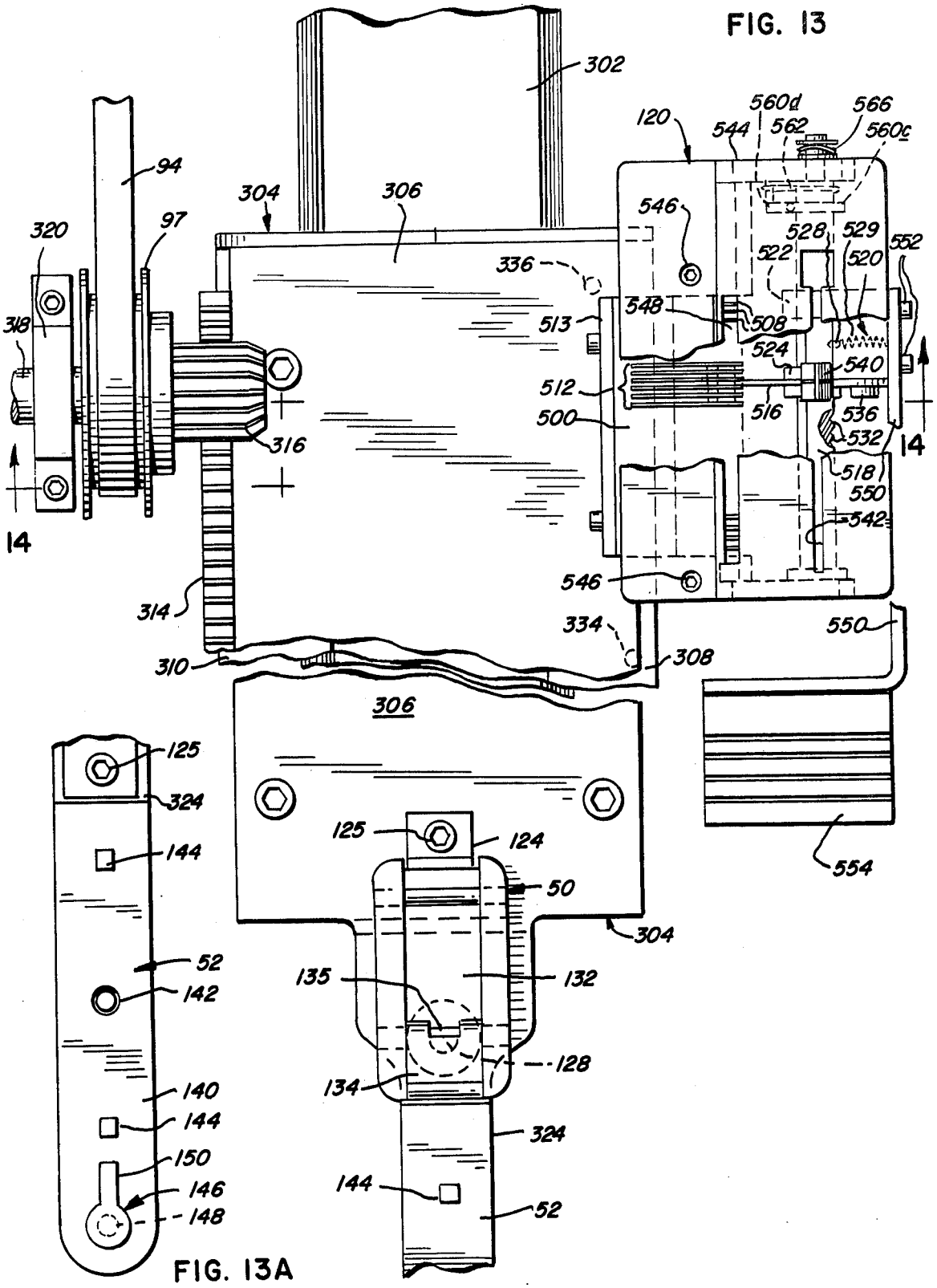
FIG. 13 is a top view of a portion of the connector carrier, and of the carriage drive and the programmer of the machine of FIG. 1.
FIG. 13A is a top view of the connector carrier of FIG. 13.

The cable clamp 50 and connector holding means 52 are mounted on a reciprocable carriage, as will be referred to further below with particular reference to FIGS. 13 and 14. With continued reference here to FIG. 3, means are provided to provide a constant unidirectional drive of this carriage. The illustrated drive means comprises a constant speed torque motor 92 with a cog-type timing belt 94 extending about the motor pulley 96 and a drive pulley 97 joined to a jack shaft 318 for a drive pinion 316 (FIG. 13). Other drive mechanisms may be substituted, such as an appropriate spring and a drive linkage connected between the movable carriage and a fixed portion of the housing in a manner to provide an essentially uniform drive force on the carriage throughout its range of operative travel.

An auxiliary display unit 98 may be included as a training aid, for conveniently indicating to an operator the proper color code of each wire to be inserted in each terminal of a connector T. The unit 98 includes a pair of drive sprockets 100 (also see FIG. 14) on an extended shaft 318 of the pinion 316. Each of a pair of cog-type timing belts 102 extends about a sprocket 100 and a pair of idler pulleys 104 and 106. The belts carry pointers 108 which move behind a translucent index plate 110 (FIG. 1) and in front of a light 111 when in use. Due to the direct drive between the pinion 136 which drives the reciprocable carriage and the pointers 108, it will be appreciated that the position of the pointers behind the plate 110 is an accurate reflection of the position of the carriage. The plate 110 may be appropriately color coded to indicate to an operator the pair of wires to be terminated for any given termination position of the carriage and thus of a connector T between the assemblies 62*a* and 62*b*. The display unit may be omitted, or may be replaced by other position coordinated indicator devices, such as a remote indicator having indicator lights which are appropriately connected to a position switch mechanism for activation in accordance with the termination positions of the carriage.

With continuing reference to FIG. 3, positioning control means comprising a linkage 114 extending from a third arm 116 of the bell crank 66*a* to a pawl control linkage system (FIGS. 15–18D) governs and controls advancing movement of the carriage and thus of the connector T. The particular illustrated advantageous linkages and pawl controls will be described further below. A carriage return or reset linkage 118 extends from the control button 44 to the same pawl control system. A selectively presettable programming means is provided in the form of a programmer 120 for selective skipping of termination positions as the carriage and the connector T are advanced during the operation of the machine 30.

More detailed descriptions of the various components and subassemblies and their operations and features will be set forth with particular reference to the further figures of the drawings.

Figure 2:
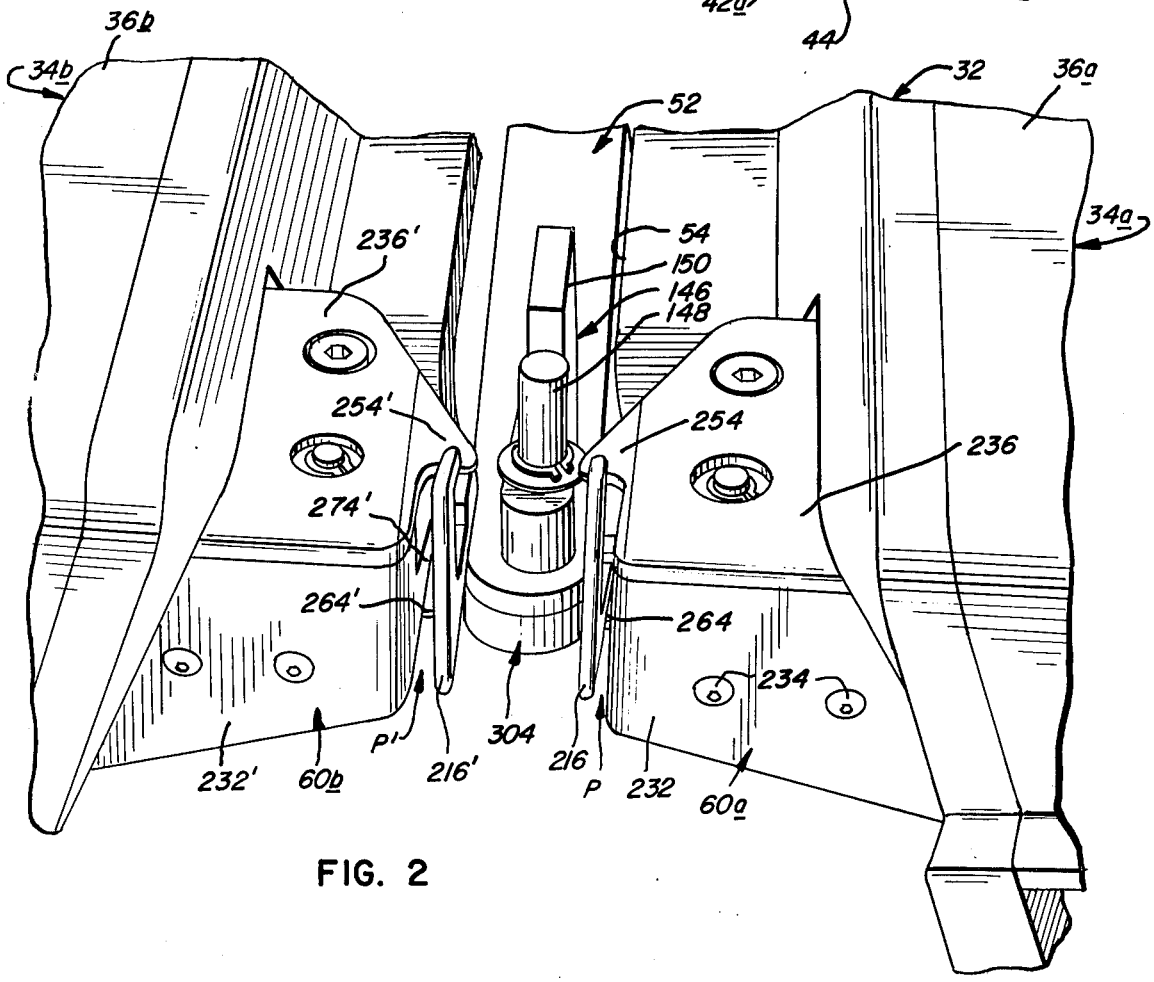
FIG. 2 is an enlarged perspective view of a portion of the machine of FIG. 1 at the termination station.
Figure 5:
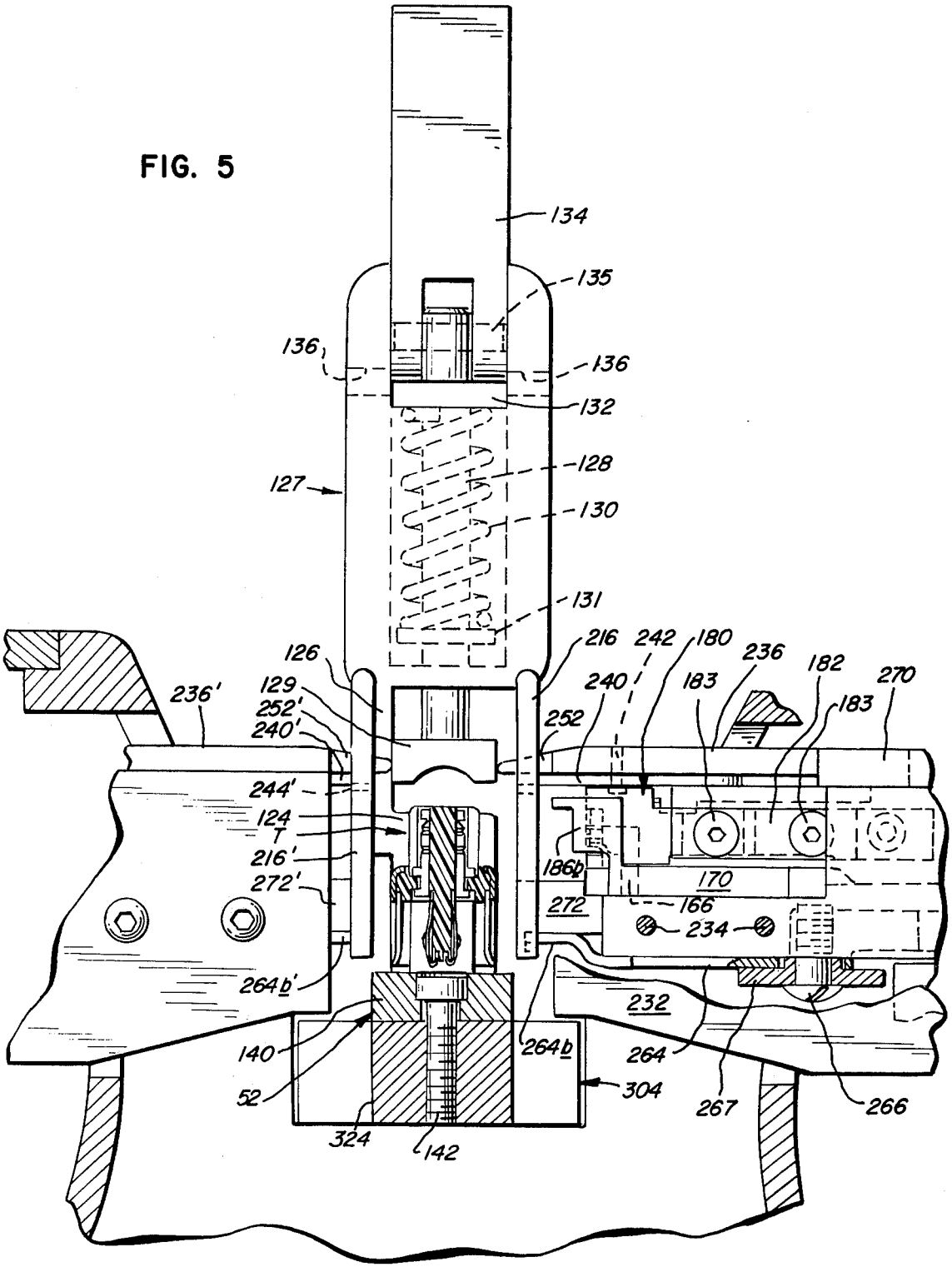
FIG. 5 is an enlarged front elevation of the machine components of FIG. 4, with the connector, nest, carrier and parts of the housing in section, with part of the front cover of the right-hand wire insertion assembly broken away and with the cable clamp raised.

Referring to FIGS. 5 and 13, as well as to FIGS 1–3, the illustrated cable clamp 50 includes a base 124 by which the clamp is mounted atop a carriage 304, as by screws 125. A side frame portion 126 extends upward from the base to a main body portion 127 which receives a reciprocable plunger 128, having a lower presser foot 129. A compression spring 130 is confined between a washer 131 fixed to the plunger 128 and atop wall 132 of the body portion 127. A cam-type operating lever 134 has rocking engagement atop the wall 132 and receives a pin 135 which also extends through the upper end portion of the plunger 128. Pin 135 is eccentrically disposed of the lever 134, whereby raising of the lever 134 as in FIG. 5 will cause lifting of a plunger 128 against the force of spring 130, and release of the lever will result in clamping an intervening cable between the foot 129 and the upper surface of the base portion 124 in the manner seen in FIG. 4. The pin 135 is installed through passages 136. It will be appreciated that a variety of other clamping devices of various designs may be utilized for holding the cable.

Figure 23:
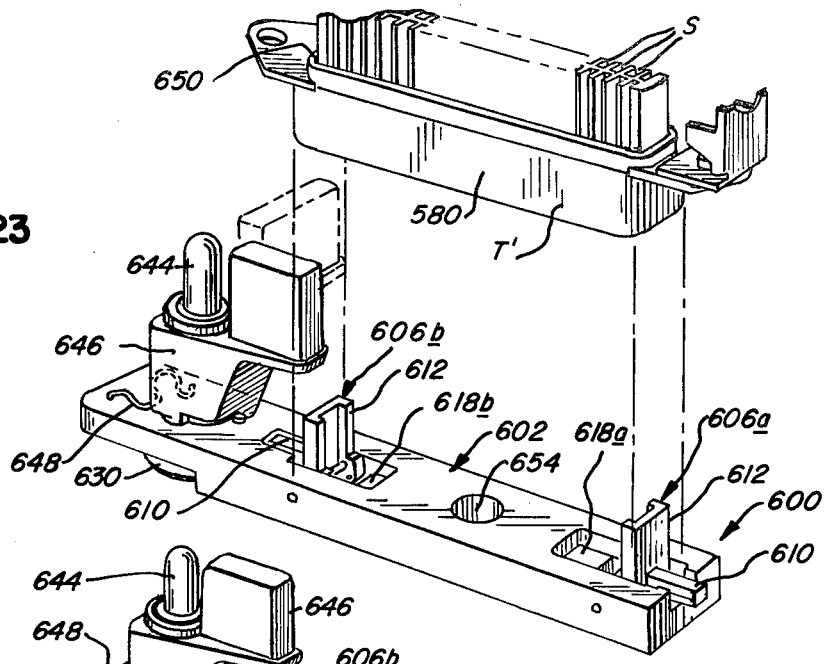
FIG. 23 is a perspective view of a universal nest for male and female connectors of one type, with an aligned connector, for use on the machine of FIG. 1.
Figure 24:
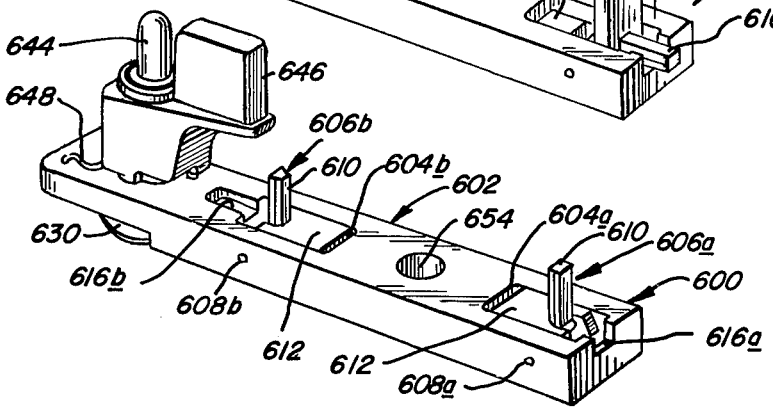
FIG. 24 is a perspective view of the nest of FIG. 23 as set to receive and hold female connectors.
Figure 27:
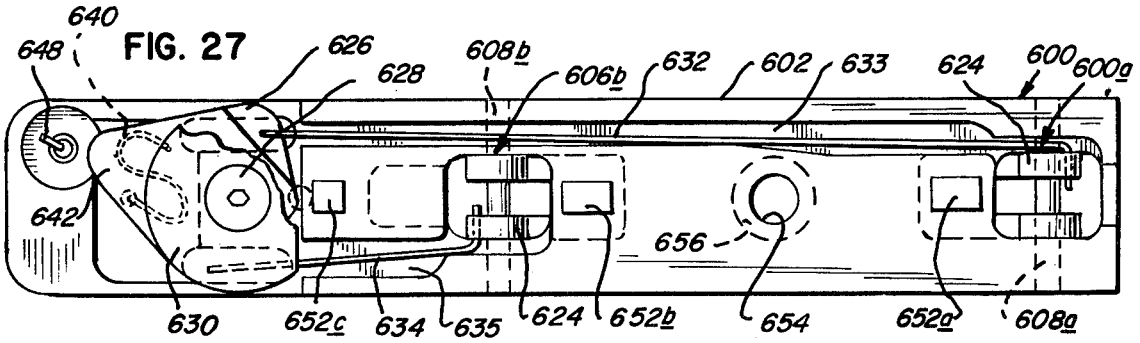
FIG. 27 is a bottom view of the connector of FIGS. 23 and 24.

Referring to FIGS. 13 and 13A as well as FIG. 4, the illustrated connector holding means or connector "nest" 52 is a removable unit which includes a base plate 140 having one or more keys (not shown) protruding from its lower surface and engaging matching alignment keyways in the upper surface of the carriage extension 324 to effect accurate lateral positioning of the holder. A machine screw 142 extends through the plate 140 and into the carriage extension for securing the holder in position. A pair of posts 144 extend upwardly from the plate 140 for engaging appropriate parts of a connector T to effect proper longitudinal registry of a connector held by the holder means relative to the other elements of the machine 30, as well as proper lateral positioning of the connector. By way of example only, the posts 144 shown in FIG. 13A are intended to engage the opposite inner end walls of the precision molded plastic portion of the open connector end of a female fifty wire solderless connector presently made and sold by TRW Inc. as noted above. A pivot clamp 146 is mounted on a post 148 at the forward end of the holder 52 and includes an arm 150 which overlies a forward shoulder of the connector T when in the locked position of FIG. 4. An S-shaped over-center toggle latch spring (see FIGS. 23, 24 and 27) may be provided for snap action locking of the latch in the lock position of FIG. 4 and in a 90° retracted position to which it is moved for removing and inserting connectors on the holder 52. It will be appreciated that a variety of connector holding devices may be utilized in accordance with the design and configuration of specific connectors to be terminated on the machine 30, including, without limitation, holders adapted to the differences between male and female connectors as well as the differences between connectors of various manufacturers. Further examples of improved nests to supplant holder 52 and each adapted to hold both male and female connectors of particular designs are illustrated in FIGS. 23, 24 and 27 and are described below.

The two insertion assemblies 62*a* and 62*b* are identical to one another in construction, except that the assembly 62*b* is a mirror image or left-hand version of the right-hand assembly 62*a*. Thus, only one of the assemblies 62*a* will be described, having particular reference to FIGS. 5–10. As perhaps best seen in FIGS. 6–8B, each of these assemblies includes a base block 160 having a longitudinally-extending slide channel 162 extending from the rear end to an enlarged recess 164 at its forward end. A cam pin 166 projects upwardly from the floor of recess 164. A reciprocable wire grip and insertion assembly is slidably supported in the channel 162 and recess 164, and comprises a drive bar 168 and wire gripping and locating sub-assembly 170. The bar 168 is formed with an elongated opening 172 for lost motion sliding reception of a pin 174 mounted in one end of the main bar 175 of the subassembly 170. The forward end of the bar 168 is formed with a shallow S-shaped top cam slot 176 including laterally offset portions 176*a* and 176*b* joined by a shoulder 176*c*. A recess 178 is formed in the forward side of the inner end of bar 168, to receive the mounting end portion 180*a* of an insertion blade 180 together with a clamp plate 182 and a pair of screws 183 by which the blade 180 is securely attached to the bar 168 with the insertion end portion 184 extending beyond the inward end of the bar 168, see also FIGS. 7, 12 and 12B.

Figures 8, 8A, 8B:
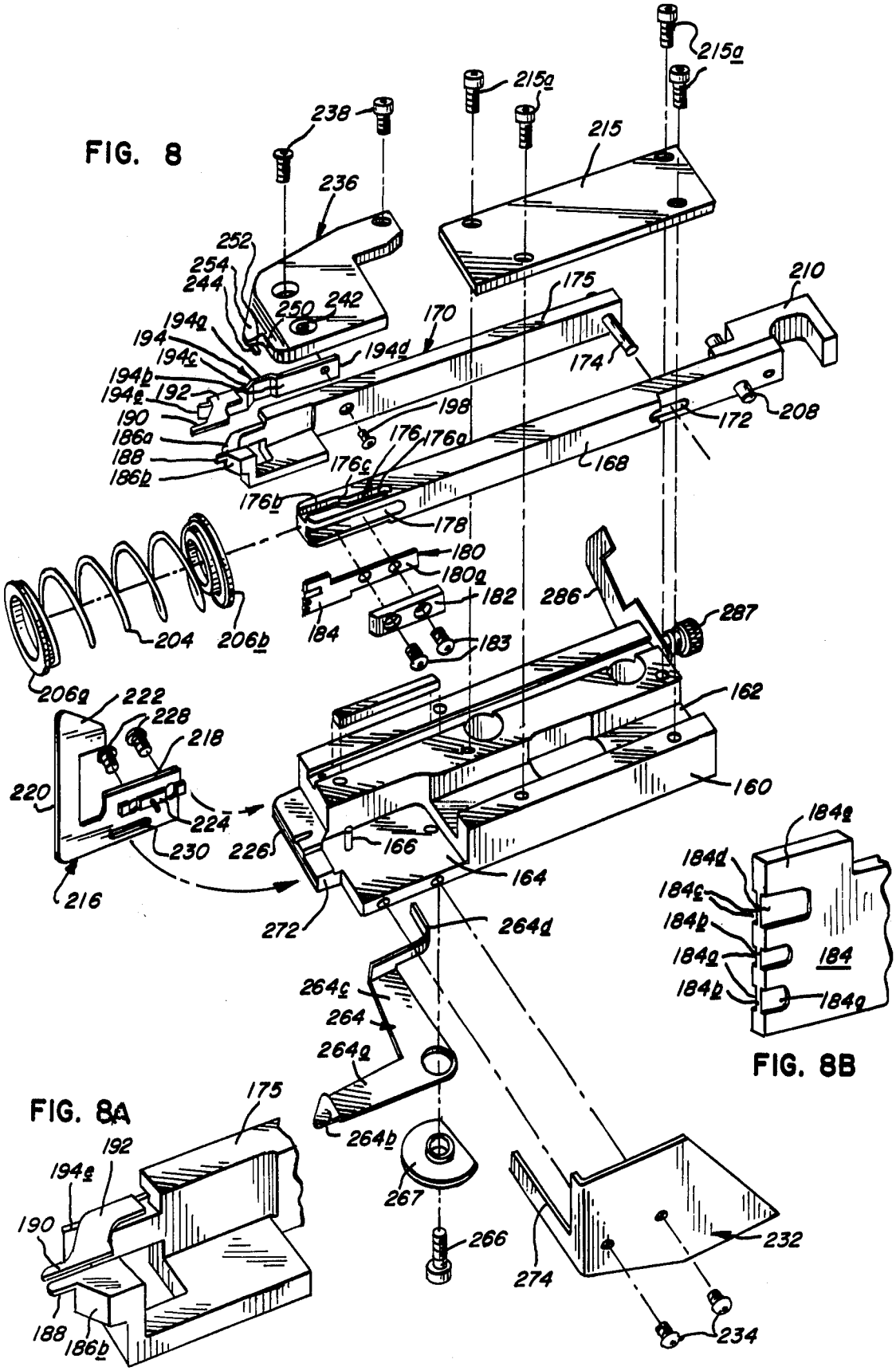
FIG. 8 is an exploded perspective view of the wire insertion assembly of FIGS. 6 and 7.
FIG. 8A is an enlarged view of the wire channel gripper head of the assembly of FIGS. 6 and 7.
FIG. 8B is an enlarged perspective view of the wire engagement end of the insertion blade.

The insertion assembly 170 further includes a pair of spaced-wire channel defining means 186*a* and 186*b*. Element 186 comprises a forward portion of the main bar member 175, as illustrated, while element 186*b* is a part of an offset portion as best seen in FIG. 8A. The two elements 186*a* and 186*b* are blunt-nosed and include parallel spaced-opposed wire channel defining surfaces extending vertically a distance approximately equal to the vertical length of a wire receiving terminal in connector T, for purposes to be referred to further below.

Figure 10:
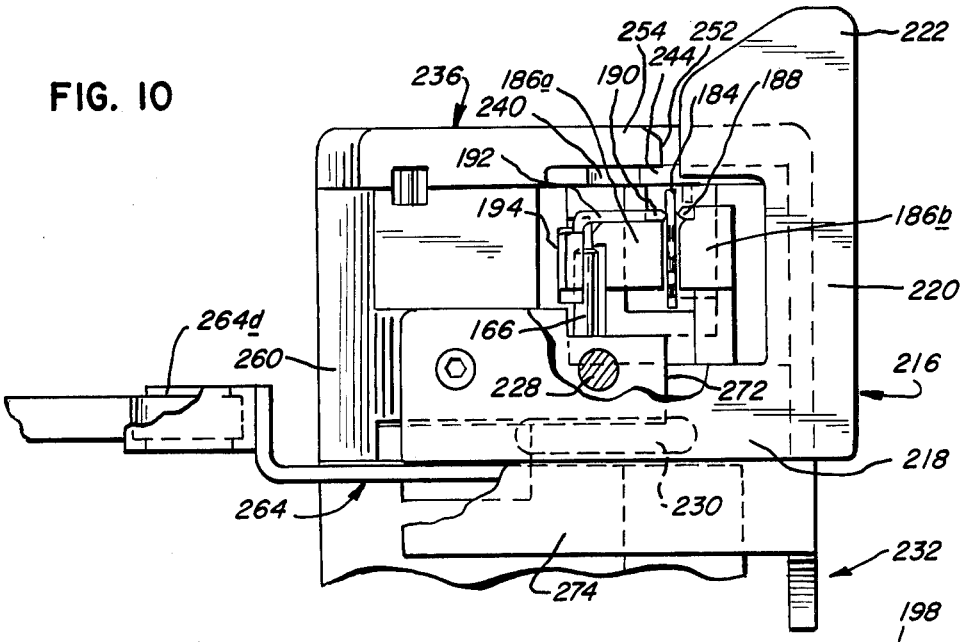
FIG. 10 is an enlarged left-end view of the wire insertion assembly of FIG. 7.

A gripper finger 188 (also see FIG. 10) extends forward from the upper inner corner portion of the element 186*b*. An opposing finger 190 comprises a forwardly extending portion of an L-shaped element 192 which extends over the top of and down along the outer side of the element 186*a*. The element 192 is unitarily attached to the forward upper edge of a spring finger 194 which includes an offset portion 194*a*, cam shoulder portions 194*b* and 194*c*, a base leg portion 194*d*, and a forward flared cam end 194*e*. The leg portion 194*d* extends into a recess 196 in the outer side of the main bar 175, see FIGS. 6 and 11. A screw 198 attaches the finger component 192–194 to the bar body 175, whereby the spring finger 194 resiliently biases the forward portion of the element 192, including finger 190, toward the finger 188 and the corresponding aligned upper inner edge of the portion 186*b*, see FIG. 10. The opposed edges of the fingers 188 and 190, and the respective aligned upper inner edge portions of the elements 186*b* and 192, constitute means for gripping a wire while the wire is trimmed and transferred into a terminal of the connector T. To facilitate this gripping function without penetrating or rupturing the insulation of the wire at the gripping points, the opposed gripping edges preferably are beveled, as best seen in FIG. 10, but are not sharp edged.

Figures 6, 7:
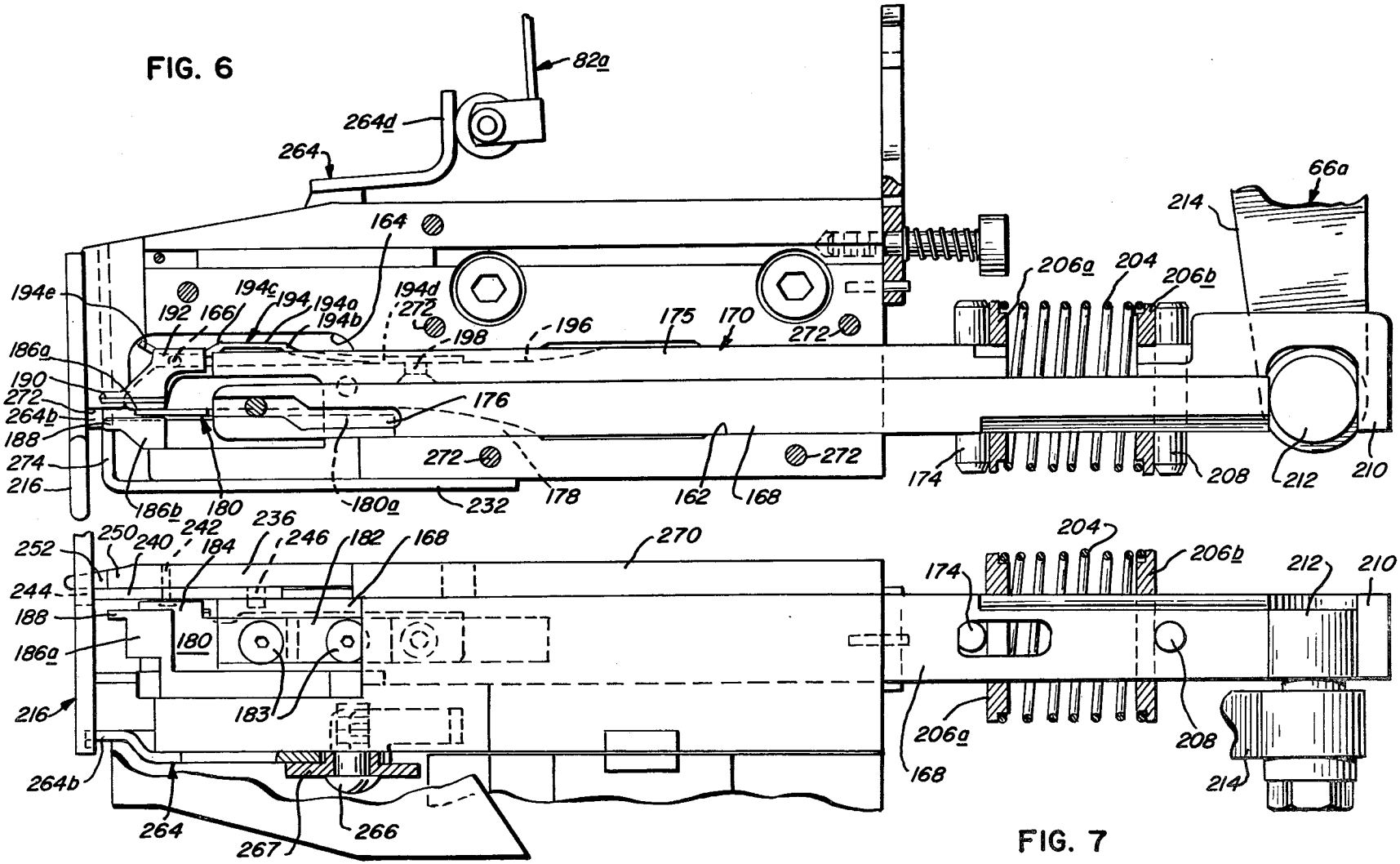
FIG. 6 is an enlarged top view of the right-hand wire insertion assembly of the machine of FIG. 1, with the top cover plates removed.
FIG. 7 is a front elevation of the assembly of FIG. 6.
Figure 11:
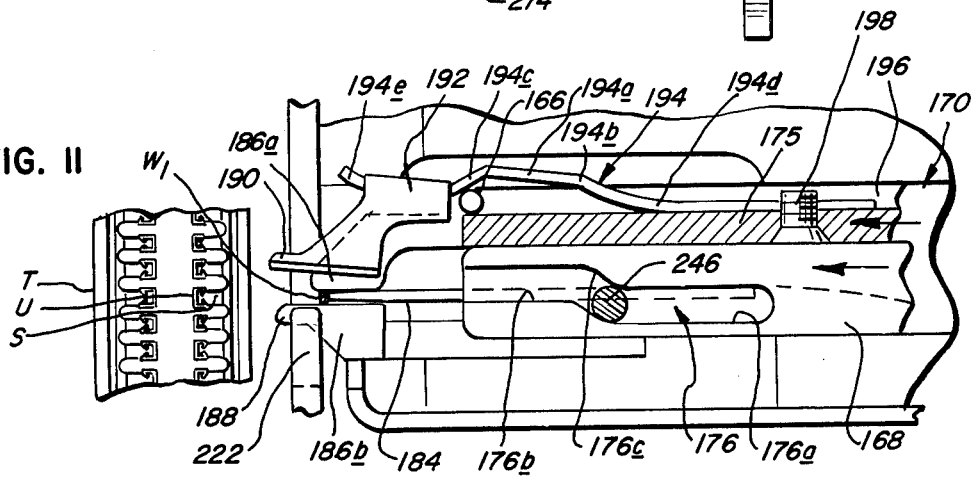

The bar 168 and assembly 170 are assembled in face-to-face relation and are jointly positioned in a sliding/-guiding relationship in the guideway 162, with their forward end portions in the recess 164, as seen in FIG. 6. The pin 174 extends into the elongated slot 172 to provide a lost motion connection between these two members. A compression spring 204 surrounds the bar 168 and is confined between a pair of bushings 206*a* and 206*b* which abut the pin 174 and a transverse pin 208 near the outer end of arm 168, respectively. The spring 204 thereby biases the channel and gripper assembly 170 to its extended position relative to the insertion bar 168, within the ambit permitted by the slot 172. A C-shaped drive element 210 is attached to the rearward end of the bar 168 for engagement with a drive pin 212 mounted in one arm 214 of the bell crank drive 66*a*, see FIGS. 3 and 6. This provides the drive connection for reciprocating the assemblies 168 and 170. The outer or rear surface of the bar 175 is adjacent the forward edge of the cam pin 166, and spring finger 194 engages the opposite surface of the pin 166 to provide a cam action for retracting and releasing the finger 190 and member 192, as seen in FIGS. 6, 11 and 11A, during the reciprocating movement of the insertion mechanism.

A cover plate 215 is attached to the top of the slide block 160, over the assembled slide components 168 and 170 and attached as by screws 215*a*.

With continuing reference to FIGS. 5–8, as well as to FIG. 2, the assembly 62*a* further includes a knife blade member 216 comprising a base blade portion 218, an upstanding leg portion 220, and an upper end portion 222. The base portion 218 is formed with raised key portions 214 for mating engagement with a matching key slot 226 at the end of slide block 160 for accurately positioning the plate 216 when it is attached to the end of block 160 by screws 228. An elongated recess 230 is formed in the lower inner face of the face portion 218, for purposes to be noted. The upper inner corner of the base 218 cooperates with the lower forward edge of the insertion blade 180 for trimming wires as they are transferred to the terminals of a connector T.

A cover plate 232 extends over the front surface of the inner end portion as well as a part of the inner end surface of the assembly 62*a* being retained by a pair of screws 234.

Figure 9:
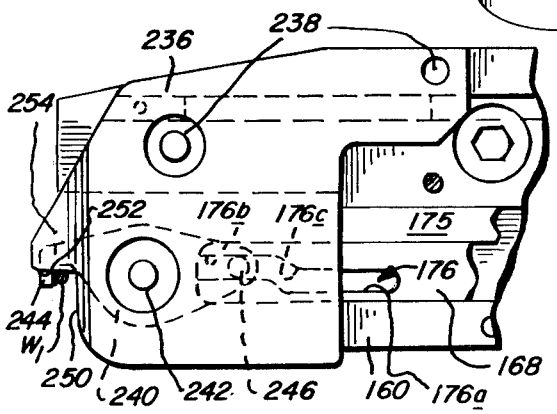
FIGS. 9 and 9A (sheet 3) are top views of the inner end of the right-hand wire insertion assembly, with the wire stop finger in release position in FIG. 9A.
Figure 9A:
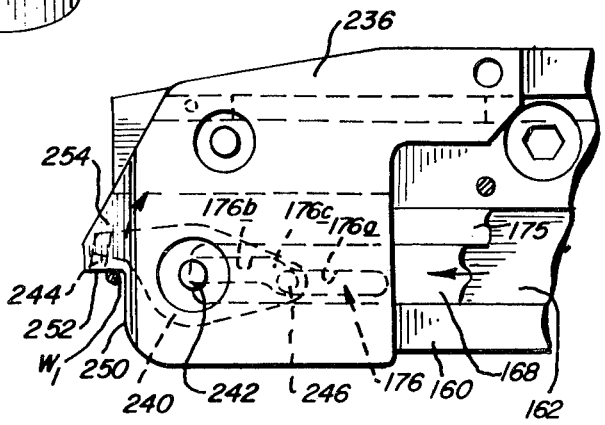

A top plate 236 is attached to the upper surface of the inner end portion, as by screws 238. With particular reference to FIGS. 7, 8, 9 and 9A, a wire retainer lever 240 is pivotally mounted on a pivot pin 242 mounted in the plate 236. The lever 240 includes a retainer leg or tab 244 at its inner end, with this tab extending generally parallel to the longitudinal axis of the machine 30, i.e., parallel to the path of movement of the carriage 304. An operating stud 246 is mounted in the outer end of the lever 240 and extends downwardly into the cam slot 176 for effecting pivotal movement of the lever 240 for extension and retraction of the retainer tab 244 during the operation of the assembly 62*a*, as will be described. The plate 236 includes a forward inner shoulder surface 250 which extends to and terminates at a lateral edge surface 252 of a nose portion 254. As best seen in FIG. 9, the retainer tab 244 projects forwardly across the surface 252 when the follower pin 246 is in cam slot portion 176*b*, i.e., with the bar 168 retracted. In this extended position, the tab 244 is generally horizontally aligned over the blade 216 and extends closely adjacent the rearward edge of the upper end portion 222. The tab 244 is retracted beneath the nose 254, behind edge surface 252, when the follower pin is in the slot portion 176*a* during forward positioning movement of the bar 168, as in FIG. 9A.

A trigger switch operating lever 264 is pivotally attached to the underside of the slide block 160 as by a screw 266 and a bearing washer 267. The switch operating lever 264 includes a first arm 264*a* which extends forward and includes an outer tab end 264*b*, the tip of which extends into the slot 230 of plate 216, see FIG. 7. Thus, the forward edge of the tab 264*b* extends across the respective wire pocket as seen in FIG. 6 and is exposed for engagement of that tab by a wire positioned by an operator as in FIG. 4. The lever 264 includes a further arm 264*c* which extends beneath the block 160 and carries an extension 264*d* in a position to engage the operating arm 270 of trigger switch 82*a* for actuating that switch to an "on" position when a wire is properly positioned in the respective pocket against the tab 264*b*.

It will be appreciated that the cover 232, plate 236, knife plate 216 and retainer 244, together with a shoulder 272 of block 160, define a pocket P (see FIGS. 2–4) which is open both laterally (forwardly toward the operator) and vertically for receiving wires to be positioned therein by the operator. The upper forward and inward limits of this pocket are defined by the short fixed stop edge 252 and the retractable stop tab 244, both of which are above the top of a connector T, See FIGS. 5, 12 and 12A. As a wire W is swung downward and pulled into the pocket by the operator, the wire's forward movement is unobstructed until the upper portion of that wire comes to rest against the fixed stop surface 252 between the tab 244 and the surface 250, as illustrated by wire $W_1$ in FIGS. 4 and 9. The wire normally slides inward along surface 252 due to the angle of the wire from the clamp, but is retained against movement toward the connector by the stop tab 244. Thus the wire is trapped as in FIG. 9 until tab 244 is retracted as in FIG. 9A. Moreover, the lower portion of the wire in this pocket is trapped between the knife blade portion 218, the opposed leg 274 of the cover 232 and the shoulder 272. As a result, the trapped portion of the wire is in substantially vertical coplanar alignment with the insertion mechanism 62*a*, and the respective receiving terminal of a connector T, and with the longitudinal axis of the wire substantially vertical, for accurate consistent trimming and transfer into an aligned terminal of connector T by the insertion mechanism.

Figure 12:
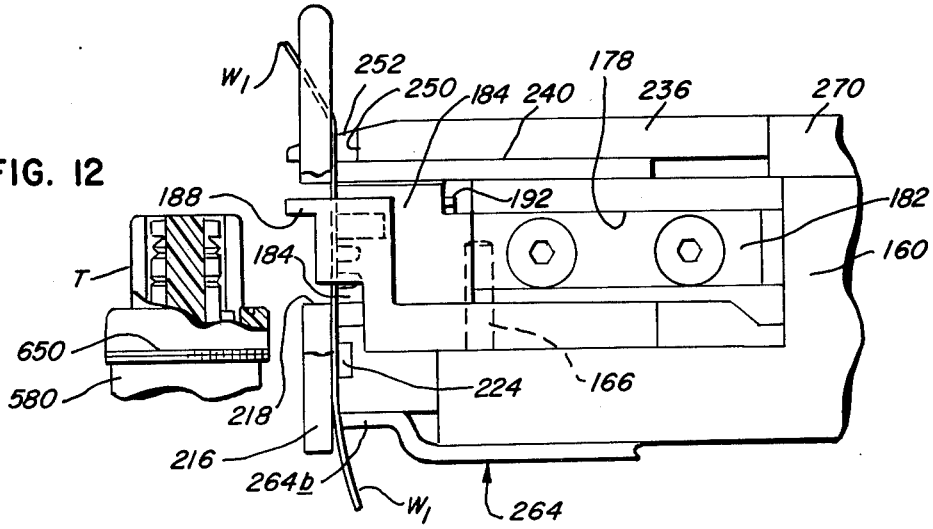

The operation of the transfer and insertion mechanism 62*a* will be described, assuming that a wire has been positioned as just described above. As indicated, such a wire is in a vertical plane generally in alignment with the space between the opposed inner surfaces of channel elements 186*a* and 186*b*. When the drive means 64*a* is actuated to move the slide bar 168 forward, spring finger 194 engages pin 166 and thereby retracts the gripper finger 190. The wire grips 188 and 190 and the opposed channel surfaces of elements 186*a* and 186*b* then move straddle of the aligned wire portion as the leading edge of the ram 180 moves into abutment with the wire as illustrated in FIGS. 11 and 12. It will be noted that the wire is trapped and confined between the opposed surfaces of the elements 186*a* and 186*b* and is in a predetermined vertical position defined by the inner surfaces of retainer 244 and the knife blade portion 218. The engaged wire portion to be inserted in the respective terminal U thus is oriented with its axis parallel to the axis of the terminal and in coplanar relation to the entrance slot S to the terminal. The shoulder 194*c* of the spring finger then clears pin 166 permitting the grip finger 190 to engage the wire against the edge of gripper 188. Substantially simultaneously the cam slot shoulder 176*c* pivots lever 240 to retract retainer leg 244 as in FIG. 9A. Thereafter, as the bar 168 continues to advance, the blade 180 and the wire gripper and channel subassembly 170 carry the engaged portion of the wire forward to transfer the wire to the connector T. At the beginning of this motion, the lower forward corner of the blade end 184 cooperates with the upper inner corner of the knife blade portion 218 to sever the excess (lower) portion of the wire. Continued forward movement results in advancing of the wire, with the wire being laterally confined by the surfaces of the elements 186*a* and 186*b* and held against axial movement by the gripper elements 188 and 190, such that the wire remains precisely positioned in a vertical orientation in coplanar alignment with the opening to the respective terminal slot S of the connector.

It will be noted that the blade end 184 extends upward between and above the grippers 188 and 190. Thereby the wire is abutted by the blade 180 above the gripping plane as well as beneath that plane, thereby avoiding tilting of the wire insertion portion as might otherwise occur due to application on only one side of the gripping plane of the force necessary for the repositioning movement of the wire.

The gripping and alignment components advance together in the noted relative positions until the forward blunt noses of the elements 186*a* and 186*b* abut the ribs of the connector T on opposite sides of the slot S, as in FIGS. 11A and 12A, and the grip assembly is stopped. It will be appreciated that at this point the slot S becomes a continuation of the channel space between the elements 186*a* and 186*b*. Thereafter, the bar 168 and blade 180 continue their forward movement, due to the lost motion connection 172-174-204, whereby the leading edge of the insertion blade 184 pushes the wire portion $W_1$ into the slot S and finally into the terminal U which is located at the inner end of that slot. The blade end 184 drives the wire into its fully seated position in the terminal U, as in FIGS. 11B and 12B, with the wire being pressed against the rear wall of the terminal and firmly engaged by the jaws J which effect electrical contact with the conductor of the wire and being engaged in the strain relief elements K of the terminal. The gripper fingers 188–190 maintain their gripping action during this transfer and termination, with the wire being slid therealong during its final movement into the terminal. Also, the elements 186*a* and 186*b* together with the ribs at each side of the slot S provide continual lateral confinement support for the wire throughout the transfer and termination.

The particular terminals of the illustrated connector T are described in further detail in the aforementioned copending applications. In summary, the wire termination portion of each terminal is of a generally U-shaped elongated channel configuration open to one side of the connector and with each terminal channel open to the top of the connector at one end as illustrated. The side walls are formed with two pairs of opposed inwardly protruding jaws J, and a pair of inwardly projecting strain relief tabs K. Each pair of opposed jaws J of a terminal are spaced part a distance such that as the wire W is forced therebetween, the jaws rupture the insulation and establish electrical contact, preferably gas-tight contact, with the conductor. Simultaneously, as the wire is pressed between the tabs K, these tabs mechanically engage but preferably do not rupture the insulation, thereby providing mechanical engagement of the wire for strain relief purposes. By way of example only, about 35 pounds of thrust force exerted on the wire portion $W_1$ in the terminal by the outer end of blade 184 has been found appropriate for reliable termination of a wire in a terminal U of the aforementioned CINCH RIBBON connectors.

The outer end portion of blade 180 is of a configuration to accommodate the terminals of the connector. The outer end portion is of a thickness to permit entry between the side walls of each terminal U. Further, referring particularly to FIG. 8B, recesses **184*a* are formed at opposite sides in positions to register with the jaws J, thereby defining intervening narrow portions 184*b* which may pass between these jaws. Accordingly, the wire may be fully seated in the terminal without the insertion blade 184 contacting or damaging the jaws. An upper portion of the end 184 is formed with further recesses 184*c* and an intervening narrow rib 184*d* which similarly mate with the strain relief tabs K to permit insertion of the wire therebetween without damaging those tabs. The uppermost portion 184*e* extends between and above the gripper fingers 188 and 190 so that the wire is engaged above the grippers as well as beneath, to avoid tilting of the wires and thereby assist in maintaining their vertical or parallel orientation as they are transferred and inserted into the terminals, see e.g., FIGS. 12, 12A and 12B.**

In furtherance of the object of providing a machine capable of terminating a variety of connectors, the illustrated plate end 184 also is adapted for seating of wires in solderless terminals of a connector sold by Bunker Ramo Corporation under the name "MICRO PIERCE", as well as a connector sold by AMP Inc. under the name "AMP CHAMP". The latter connector is illustrated in part in FIG. 28; and also see U.S. Pat. No. 3,760,335. When terminating wires in each of those connectors, the recesses **184*a* accommodate the insulation rupturing portions of the respective terminals into which the wire is forced by the blade 180. In the Bunker Ramo connector the recesses 184*c*** accommodate a narrow strain relief configuration of the plastic housing in which the terminals are supported.

Figure 22:
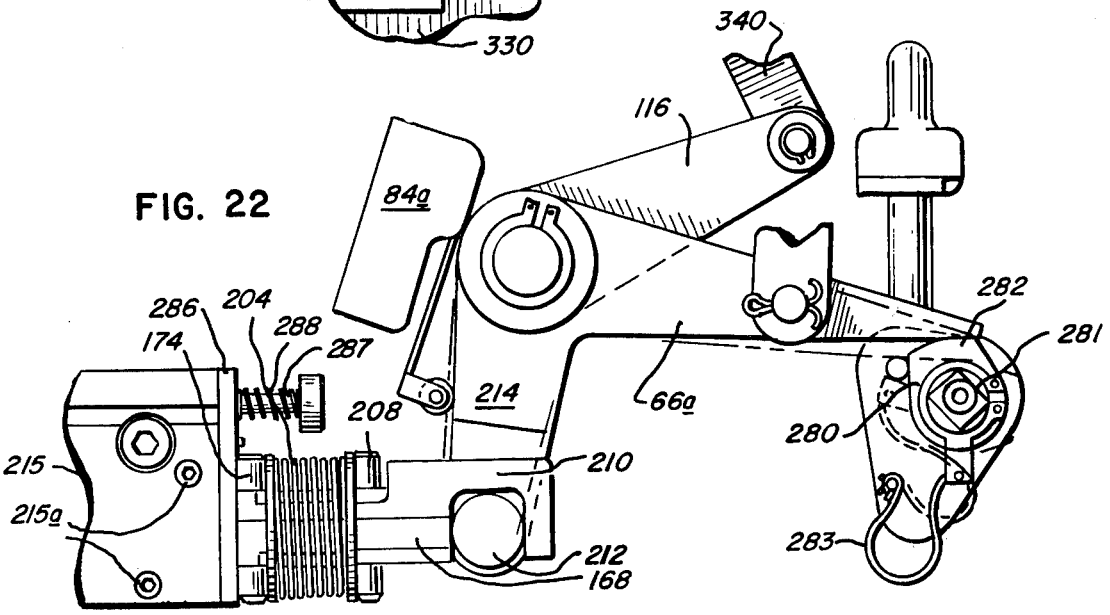
FIG. 22 illustrates the drive for a wire insertion assembly adjusted for terminating wires in connectors of another design.

The drive mechanism of the machine 30 also is readily adapted to accommodate connectors of different designs and termination parameters. As a particular example, the aforementioned "AMP CHAMP" connector is generally of a different configuration and utilizes terminals of a different type and configuration than the illustrated connector T. In terminating wires in those terminals it is desirable to avoid stresses on the connector housing adjacent the terminals and to avoid forceful seating of the wires against the bottoms of the terminals. The drive mechanism of machine 30 is readily adapted to accommodate these parameters. Referring particularly to the drive mechanism **66*a* shown in FIGS. 3 and 22, a stop cam element 280 is pivotally mounted on an eccentric pivot pin 281. The element 280 includes a lobe 282 which serves as a limit stop for arm 66*a* when the element 280 is in the position illustrated in full lines in FIG. 22. this limits the stroke of the bar 168 and blade 180 to afford proper insertion of wires in a terminal of this type while preventing forceful bottoming of the wires in the terminals. Rotary adjustment of the eccentric pin 281 provides adjustment of the insertion limit of the blade end 184. Further, a stop plate 286 is pivoted on a pin 287 mounted on the outer end of the block 162. This plate is pivotable between a retracted or inoperative position as shown in FIGS. 3 and 8 and an operative stop position as shown in FIG. 22. In the stop position of FIG. 22, the plate 286 is interposed in the path of pin 174 and limits the stroke of the assembly 170 to stop the elements 186*a* and 186*b* immediately adjacent the connector and to preclude forceful abutment of the noses of elements 186*a* and 186*b* with the connector. A compression spring 288 biases the plate 286 toward the adjacent end of the block 162. Mating projections and recesses (not shown) may be provided at the interface between the block 162 and plate 286 for retaining the plate 286 in each of its two positions. Thus, for converting the drive mechanism to use with the noted types of connectors, it is only necessary for the operator to flip the stop element 280 and the plate 286 into the proper position, i.e., with the stops interposed as in FIG. 22** for the noted AMP connector, or with the stops retracted for the TRW connector or the Bunker Ramo connector.

Switch **84*a* is closed by arm 214 when the insertion mechanism is extended and is connected in the operating circuit with the time delay relay 90 to provide a delay or pause while the bar 168 and blade 180** are in their fully extended insertion position, before retraction of the insertion mechanism.

As noted above, the insertion assembly **62*b* includes parts corresponding to those described for assembly 62*a* and is in operative connection with the bell crank arm 66*b* and the switch 82*b* in the same manner as described for assembly 62*a*. Accordingly, whenever numbers are applied to the assembly 62*b*, these are the same as for assembly 62*a*** with the addition of the prime suffix.

Figure 14:
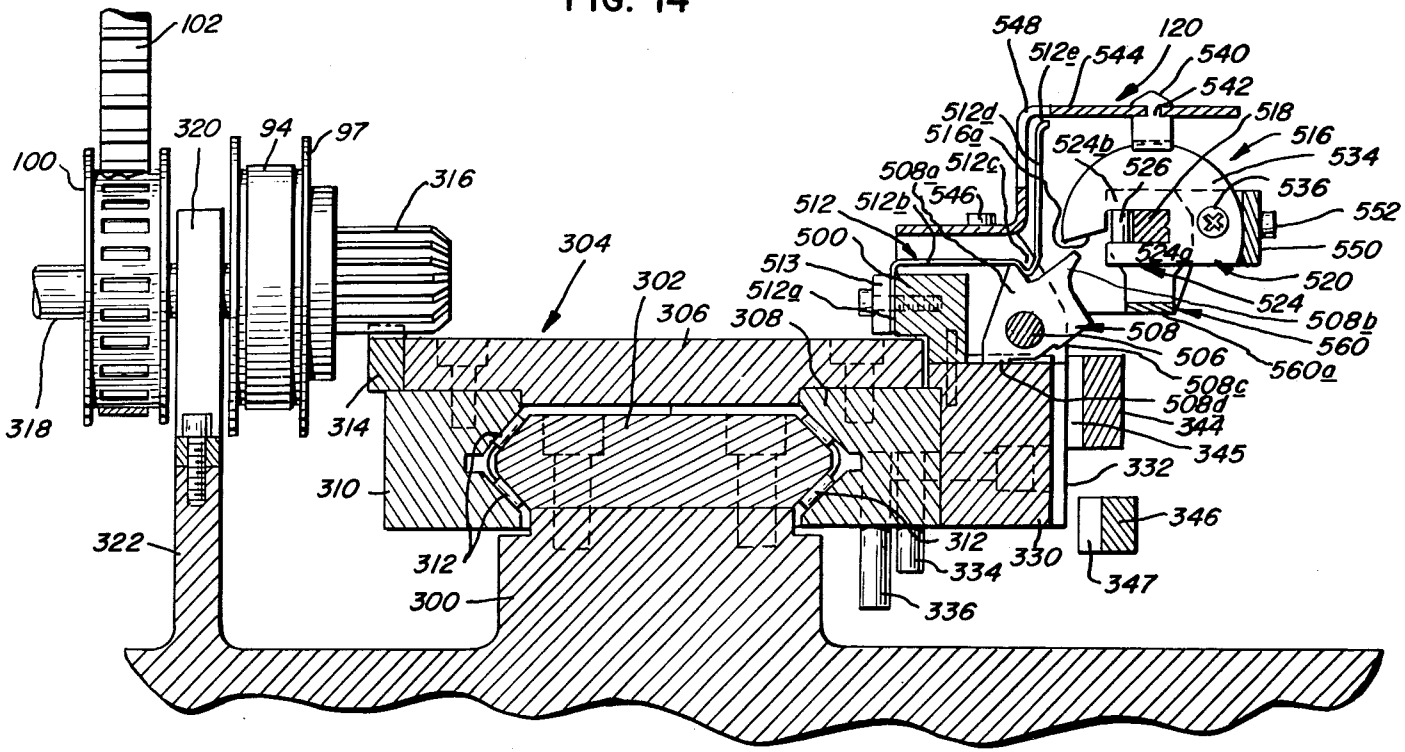
FIG. 14 is a sectional view taken along the irregular line 14—14 of FIG. 13 and looking in the direction of the arrows.

With further reference now to FIGS. 13 and 14, the housing 34 includes an upstanding longitudinal center rib 300 atop which is mounted a fixed guide or way 302 for slidably supporting the reciprocable carriage 304. The carriage 304 includes a top plate 306 to which are attached side guide members 308 and 310, which collectively have guiding and bearing engagement with way 302 by appropriate roller bearings shown schematically at 312. A rack 314 having a series of linearly aligned upstanding teeth is suitably attached to one edge of the top plate 306. A pinion 316 is attached to a jack shaft 318 journaled in a bearing 320 mounted on a housing rib 322. Thus, the axis of shaft 318 is fixed, and rotation of the shaft by the torque motor 92 will cause appropriate linear biased drive movement of the carriage assembly. The carriage plate 306 includes a narrow forwardly extending portion 324 on which the cable clamp 50 and connector holding means 52 are mounted as previously noted.

Figure 15:
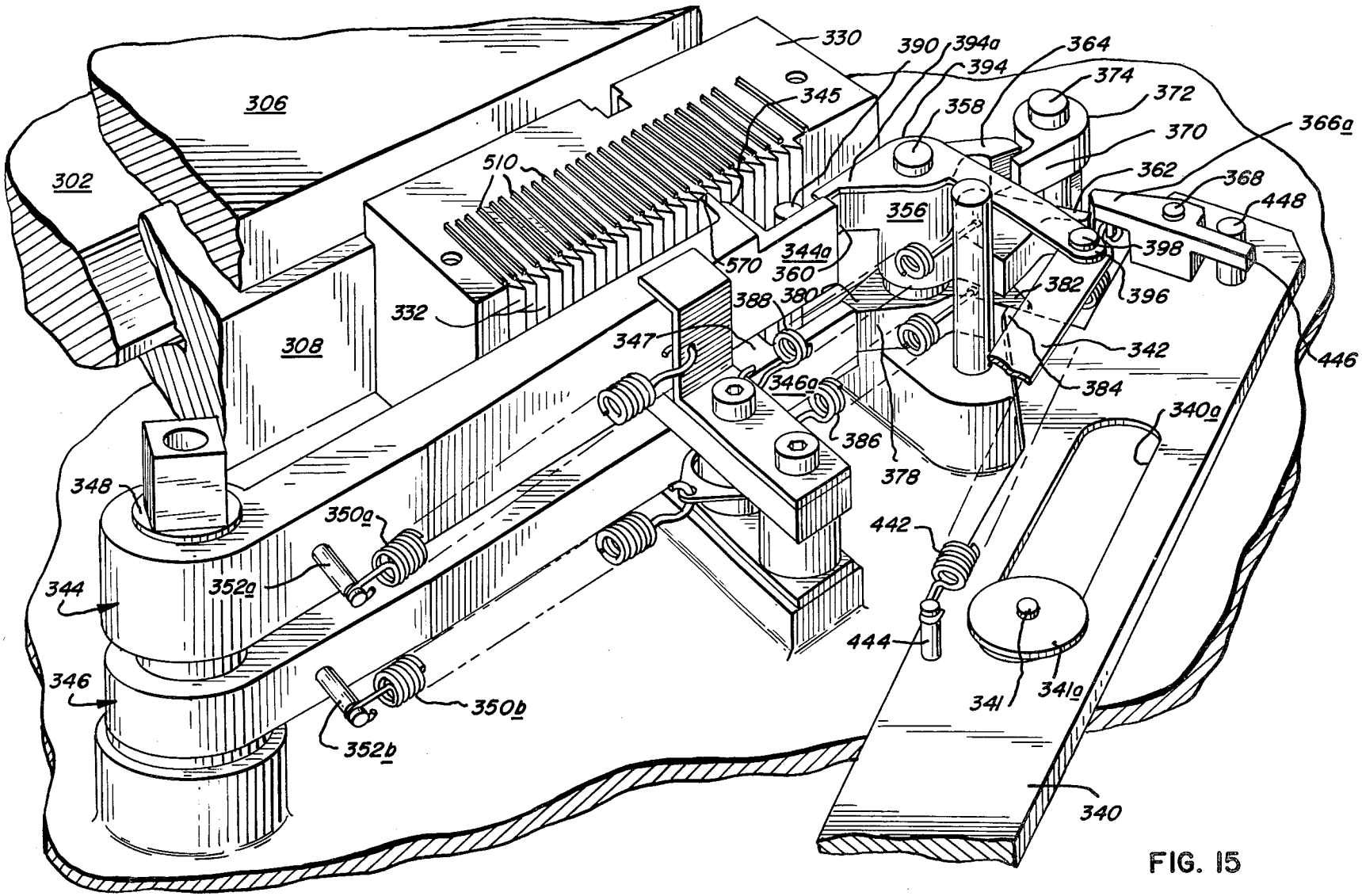
FIG. 15 is an enlarged perspective view of the ratchet mechanism and related controls of the machine of FIG. 1, without the programmer.

A ratchet bar or plate 330 is mounted on one side of the carriage assembly and includes a series of uniform ratchet teeth 332 on its exposed side, as illustrated in FIG. 15. Two latch-operating pins 334 and 336 extend downwardly from the side bar 308 for cooperating with the pawl release mechanism to be described. The automatic programmer 120 is mounted atop the ratchet bar 330, as best seen in FIG. 14.

For terminating the wires in an elongated connector T, the carriage assembly and thus the connector, are first pulled to a forwardmost position, toward the operator, against the biasing force of the drive motor 92. Successive pairs of wires then are terminated as the carriage is retracted by controlled incremental steps towards its fully retracted position of FIG. 1. In the described embodiment, the torque motor 92 provides a constant force for effecting this return motion. At the same time, this return motion is controlled for step-by-step movement to insure alignment of successive pairs of the terminals of a connector T with the insertion elements of the assemblies 62*a* and 62*b*. This return motion, as well as certain desired operating motion capabilities, is controlled by a lever and ratchet indexing assembly which will be described with particular reference to FIGS. 15–18D. The external manipulative components for operating this mechanism include a reciprocable arm 340 of the linkage 114 and a reciprocable rod 342 of the linkage system 118. It should be appreciated that the arm 340 is reciprocated forwardly from the position of FIG. 15 once during each cycle of operation of the insertion assemblies by the drive means 64*a*. The arm 342 is reciprocated to the rear of the machines selectively by the operator by manipulation of the control button 44. The outer end of the arm 340 is formed with a slot 340*a* which receives a guide pin 341 extending upward from a support on which the arm slides, and a retainer washer 341*a* is attached to the outer end of pin 341.

Referring first to FIG. 15, in which the automatic programmer 120 is omitted, the ratchet release indexing mechanism includes a pair of pawls comprising an indexing pawl 344 including a pawl tooth 345 and an intermediate or safety pawl 346 including a pawl tooth 347. Both of the pawl levers are pivoted on an eccentric post 348. These pawls are spring biased toward their ratchet engaging positions by tension springs 350*a* and 350*b* which are joined to pins 352*a* and 352*b*, respectively, with the opposite ends of the springs being attached to fixed portions of the assembly. The primary release mechanism for the index pawl 344 comprises a lever 356 which is pivotally mounted on a post 358 and includes an operating finger 360 extending behind an outer end lip 344*a* on the pawl 344. Lever 356 further includes fingers 362 and 364. Finger 362 extends into the path of the outer end portion 366*a* of a finger 366 which is pivotally mounted on a pin 368 on the reciprocable bar 340. Finger 364 extends adjacent to the finger 370 of a lever element 372 pivotally mounted on a further fixed post 374. The operating lever for the safety pawl 346 is a lever 378 pivotally mounted on the lower portion of post 358 and including a finger 380 which extends behind an outer end lip 346*a* of the pawl 346 and a finger 382 which extends into the path of a dog or lug 384 fixed on the side of the reciprocating bar 340. Tension springs 386 and 388 bias the two levers 378 and 356 toward positions in which the fingers 360 and 380 would be retracted from the pawl lips. Thereby each of the pawls 344 and 346 will rest against the ratchet teeth 332 under the biasing effect of the respective spring 350 whenever the respective lever 356 or 378 is released. A post 390 is positioned in front of the end lips of the pawls and limits their advancing movement under the force of springs 350*a* and 350*b* to insure that the pawls do not swing into the path of the ratchet bar 330 if accidentally released, while the carriage is fully retracted.

Figure 16:
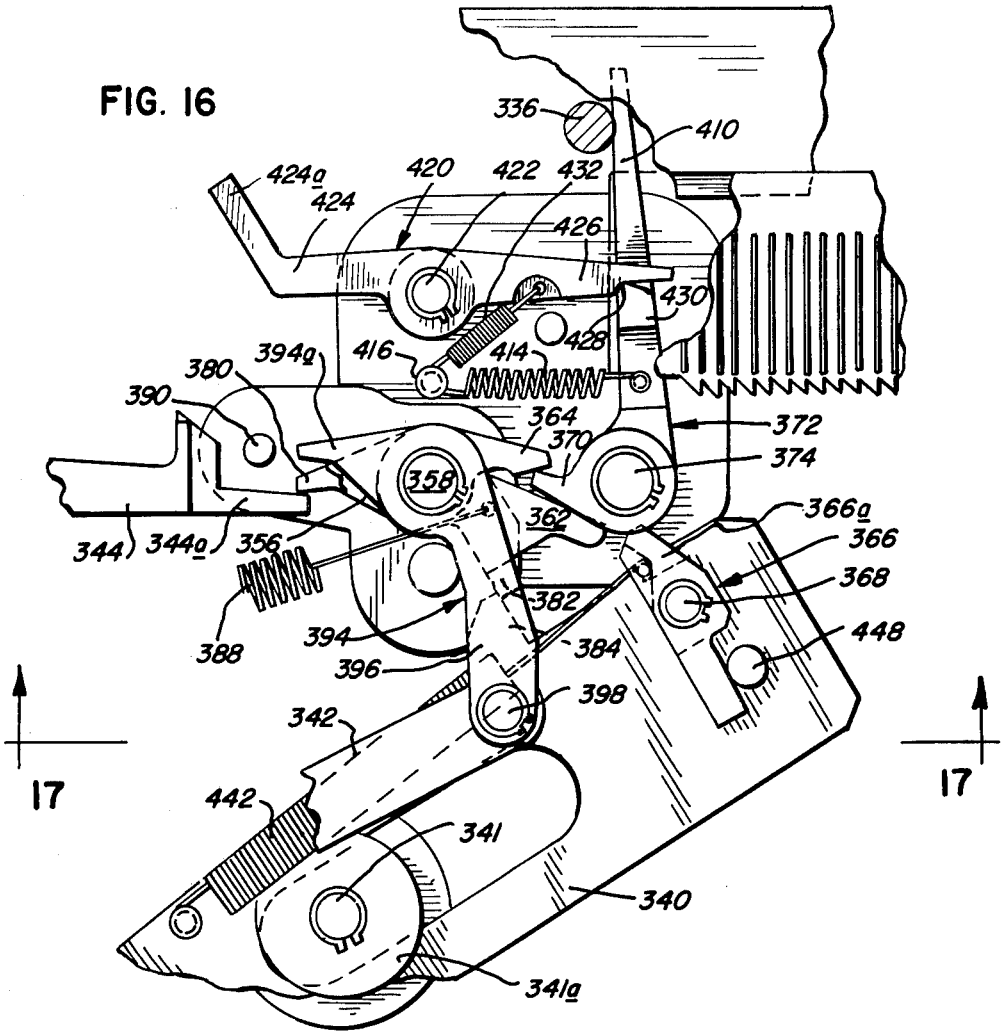
FIG. 16 is a top view of a portion of the mechanism of FIG. 15.

The dog 384 on bar 340 abuts finger 382 and thereby positions lever 378 to hold the safety or stop pawl 346 out of engagement with the ratchet teeth 332 whenever the bar 340 is fully advanced as in FIGS. 15 and 16. As will be described further below, the bar 340 is in this position whenever the insertion assemblies are retracted. In this condition of the pawl operating control, indexing pawl 344 normally is released for engagement with the ratchet teeth.

An auxiliary manual retraction system is provided for retracting the pawl 344 in the event the operator desires to manually position the carriage. This system includes a lever 394 pivotally mounted to the top portion of the post 358 and including an operating arm 396 pivotally connected to the inner end of bar 342, as by pin 398. The lever 394 further includes a finger 394*a* which also extends behind the distal end lip 344*a* of pawl 344 for retracting the pawl from engagement with the teeth 332 upon pivoting of the lever 394. Such pivoting movement is effected by the operator by pressing on the control button 44. As seen in FIG. 3, this button has a direct mechanical linkage to the arm 342 through a push rod 402 and a pivot plate 404 which is pivotally mounted on a post 406 affixed to the housing 34. A suitable spring (not shown) in the push button mechanism maintains this linkage in a normal retracted position which permits engagement of the pawl 344 with the teeth 332.

Figure 17:
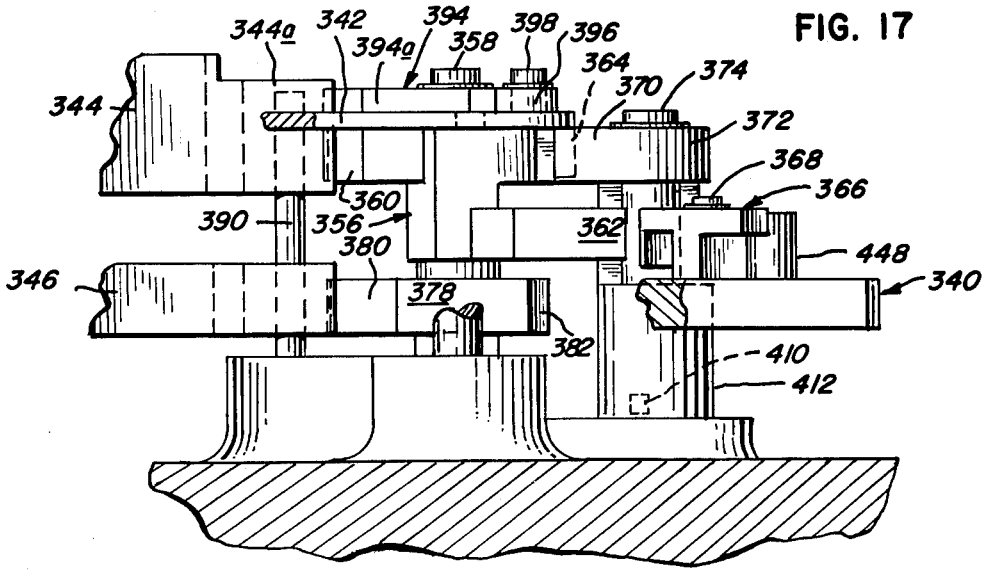
FIG. 17 is an elevation view of the mechanism of FIG. 16 as seen generally from the plane of line 17—17 in FIG. 16.

Automatic positioning of the pawl controls during initial positioning of the carriage is effected through an auxiliary control linkage which is best described with reference to FIGS. 16 and 18A. This linkage includes the lever 372 pivotally mounted on the post 374 and which includes a long latch finger 410 extending generally transversely of the carriageway, across the path of the lower end of pin 336 (FIGS. 13, 14 and 16). With reference to FIG. 17, it may be noted that lever 372 includes an elongated body portion 412 such that the finger 370 is near the top of post 374, while finger 410 is positioned near the bottom of that post such that it may project beneath the bars 308 and 330. A tension spring 414 is attached to a fixed post 416 and to lever 372 to normally maintain the lever 372 in the counterclockwise position as seen in FIG. 18A. A cooperating latch lever 420 is pivotally mounted on a short fixed post 422, beneath the path of the ratchet bar 330. Lever 420 includes an L-shaped arm 424 having a lateral portion 424*a* which projects across and in front of the path of movement of the lower end of pin 334. Another arm 426 of the lever 420 extends across the latch arm 410 of lever 372, and includes a latching shoulder 428 for latch-locking engagement with an upstanding dog 430 on the arm 410. A tension spring 432 extends between the fixed post 416 and the arm 426 to bias lever 420 in a clockwise direction as seen in FIG. 18A.

The operation of the pawl control system will be described briefly. When the drive cylinder 68*a* is retracted as in FIG. 3, bar 340 is in its normal fully retracted position as in FIGS. 15 and 16, thereby engaging dog 384 with finger 382 to maintain safety pawl 346 in its non-engaging retracted position. Further, when the carriage 304 is fully retracted as in FIGS. 1–3 for removing a terminated connector T and/or inserting a new cable and a connector in which the cable wires are to be terminated, the pin 336 rotates the lever 372 to the position of FIG. 16 whereupon lever 420 is moved into the position of latching engagement of shoulder 428 with lug 430, as seen in FIG. 16. Accordingly, the lever 372 is latched in a position in which finger 370 pivots the lever 356 to maintain the indexing pawl 344 in its non-engaging retracted position. Thus, with the latching levers 372 and 420 so engaged, the carriage assembly may be moved to its forward position without engagement of either of the pawls with the ratchet teeth.

When the carriage 304 is drawn fully forward by the operator to the position of FIG. 4, to begin terminating a connector, the pin 334 strikes the cam end 424*a* of the lever 420 and thereby pivots the lever 420 counterclockwise as seen in FIG. 18A, thereby disengaging the shoulder 428 from the lug 430 against the force of the spring 432, whereupon the spring 414 pivots the lever 372 to the position of FIG. 18A. By this motion, the finger 370 is retracted from the finger 364 of the lever 356. Accordingly, the lever 356 is rotated counterclockwise by the spring 388 thereby retracting the finger 360 from the pawl lip 344*a*, and the indexing pawl 344 is released for engagement of the tooth 345 with the first of the ratchet teeth 332 under the impetus of spring 350*a*. Thus, pawl 344 holds the carriage 304 in a predetermined linear position in which the first pair of termination recesses of the connector T are aligned with the wire insertion assemblies.

Thereafter, during each wire termination cycle, the driving of bell crank assembly 66*a* by the motive means 68*a* to advance the insertion means 168 and 170 causes concomitant movement of the arm 116 and thereby moves bar 340 to its forward position, as illustrated in FIG. 18B. This motion moves the lug 384 away from the finger 382, thereby releasing the lever 378 and the safety pawl 346 for engagement of the tooth 347 with the ratchet teeth. Further, lever 366 is moved forward past the finger 362. To permit this bypass movement, lever 366 pivots clockwise on the pin 368 (FIGS. 16 and 18A) until the outer end portion moves past the finger 362, whereupon the lever is restored to the position of FIG. 18B by a light tension spring 442 which is joined to the outer end portion 366*a* and to a pin 444 also fixed on the bar 340. An opposite end finger 446 of the lever 366 abuts a stop pin 448 also fixed on the bar 340 to limit counterclockwise motion of the lever.

Figure 18C:
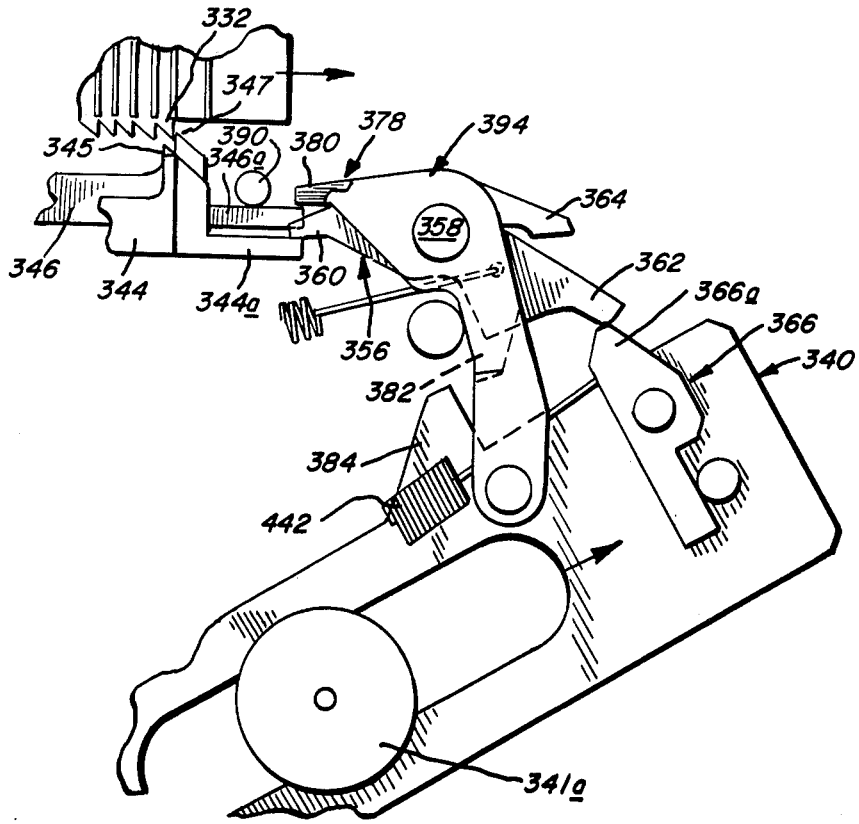
Figure 18D:
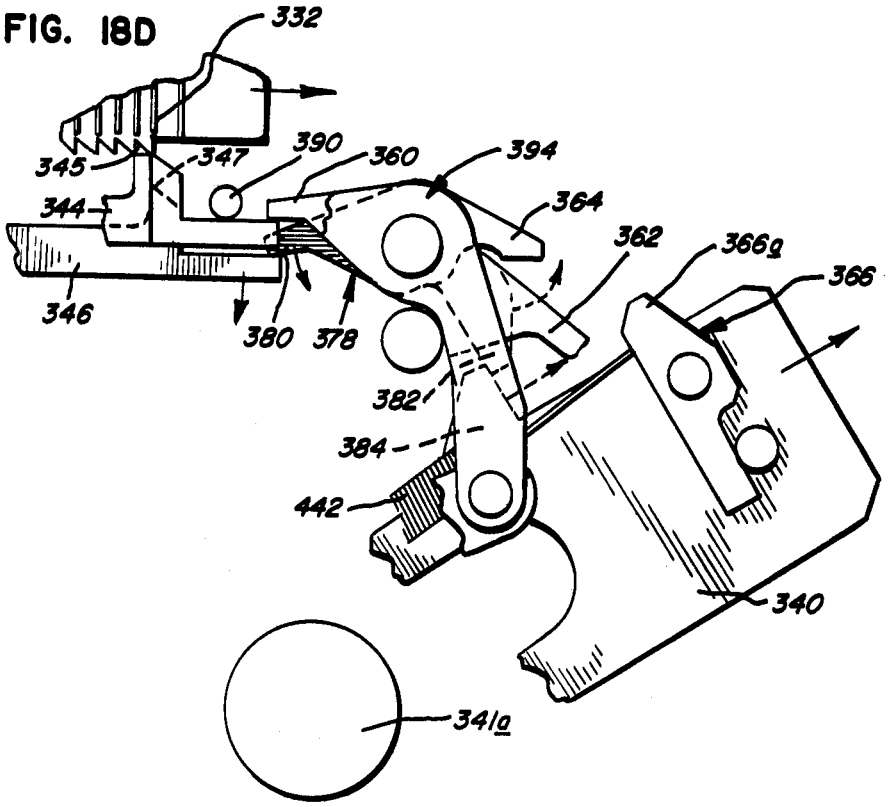

Subsequently, when the bell crank drive assembly 66*a* is moved in an opposite direction to retract the insertion means 168 and 170, the arm 340 is driven in a rearward direction as illustrated in FIG. 18C. During this rearward movement, the outer end 366*a* of lever 366 first engages finger 362 and thereby causes rotation of lever 365 to disengage the index pawl 344 from the ratchet teeth. The constant return force applied to carriage 340 by the drive means (motor 92) thereupon causes the carriage to advance until the first ratchet tooth 332 engages the tooth 347 of the safety pawl 346. The teeth 345 and 347 are offset from one another such that this carriage advancing movement is a portion of the width of a single ratchet tooth, e.g., an advancement equal to about one-half of the width or spacing of the ratchet teeth. As the bar 340 continues its rearward movement, the lever 366 clears the finger 362, whereby the lever 356 releases the index pawl 344 back to its normal engaging position. Thereafter, dog 384 engages finger 382 and pivots lever 378 to disengage the tooth 347 of pawl 346 from the ratchet teeth 332. This releases the carriage assembly 304 for continued advancing (rearward) movement until the nxt ratchet tooth 332 engages the tooth 345 of index pawl 344.

The described termination and advancement cycles are repeated until all of the terminations in a connector are completed. Thereafter, when the index pawl and the safety pawl are disengaged from the last ratchet tooth 332 in the final cycle, the carriage automatically is fully retracted by the drive means 92 to the unloading/loading position of FIG. 3. In this movement, pin 336 again operates lever 372 to reset the pawl controls for the subsequent forward movement of the carriage.

The spacing of the ratchet teeth 332 is the same as the spacing of the terminals in a connector T. The positioning of the pawl mechanisms 344 and 346 is such that each engagement of the tooth 345 of index pawl 344 with a ratchet tooth 332 positions the carriage to align one opposing pair of the terminals of a connector T with the two opposed wire insertion assemblies 62*a* and 62*b*. The eccentric pivot pin 348 provides fine positioning adjustment of the pawls to obtain precise alignment of the terminals of a connector with the insertion blades. By rotating the eccentric pin, the position of the index pawl is varied which in turn varies the insertion position of the carriage. A lock screw (not shown) is provided in the head of the pin 348 for locking the pin in a selected position.

The operator may move the carriage forward or reverse to any position, at any time between insertion cycles, such as for inspecting the connector workpiece or for terminating a skipped wire, simple by pressing release button 44 while manually holding the carriage against the bias of the drive 92. If the carriage is released, the drive 92 will return it to its fully retracted position of FIG. 3.

The programmer 120 adds a high degree of flexibility to the primary functioning of the machine 30. As described above, in normal operation of the machine in the pawl mechanism and drive means will cause the carriage assembly 304 and thus the connector T to advance a distance equal to the spacing or interval between adjacent individual terminals of a connector during each cycle of the operating means. The programmer 120 permits convenient presetting of the apparatus automatically to skip single terminals or groups of terminals in any position along the length of a connector.

Figures 19, 19A:
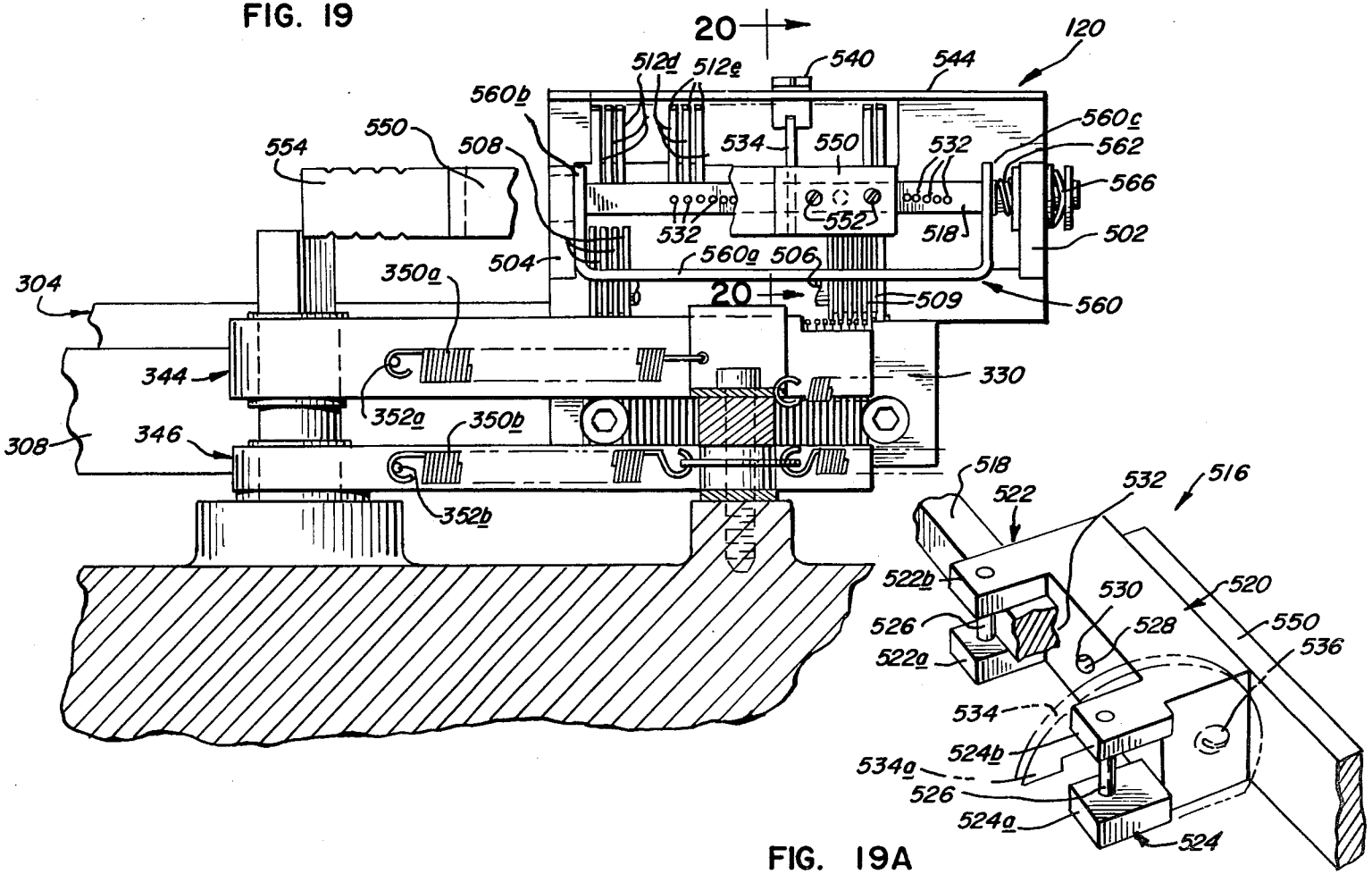
FIG. 19 is a side elevation of the programmer and the ratchet pawls, i.e., from the right side as seen in FIG. 14.
FIG. 19A is an enlarged perspective view of a portion of the slide assembly of the programmer with the trip blade shown in phantom.
Figure 20B:
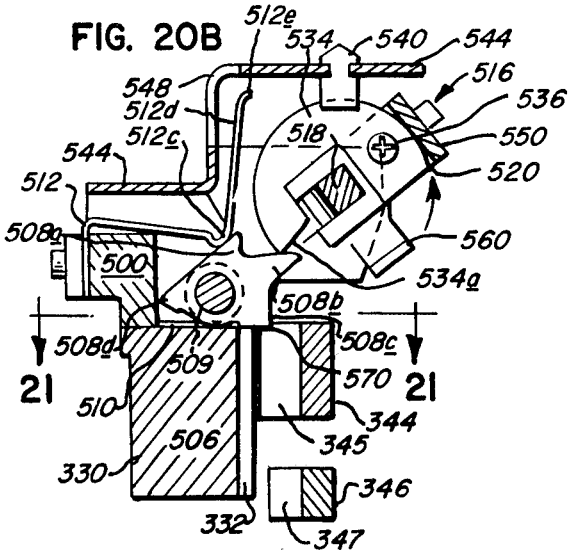
FIGS. 20A and 20B are cross-sectional views of the programmer in changed positions, as taken generally along line 20—20 of FIG. 19.
Figure 20A:
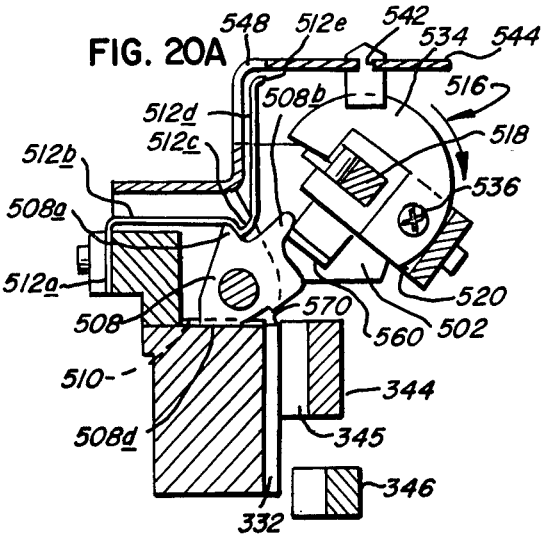
Figure 21:
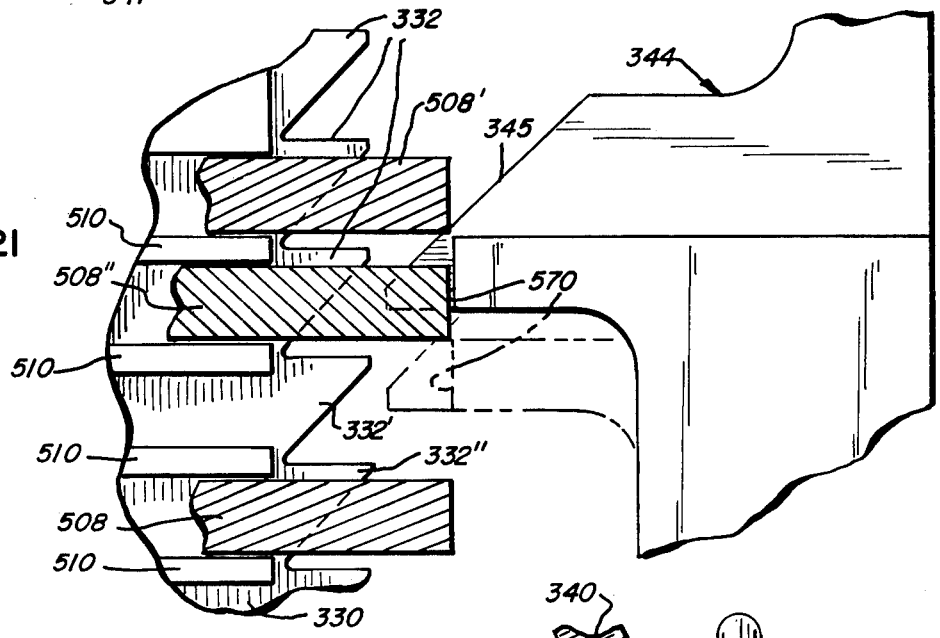
FIG. 21 is an enlarged partial view as taken generally along line 21—21 of FIG. 20B and showing the ratchet index pawl blocked out in the "skip" position by the programmer.

Referring particularly to FIGS. 13, 14 and 19, the programmer 120 includes a mounting block 500 which is suitably attached to the top of the ratchet bar 330, and a pair of parallel end support plates 502 and 504 extending from the ends of the bar 500. A support rod 506 is supported by the end plates and extends longitudinally of the programmer as shown. A plurality of stop blades or "reject" blades 508 are rotatably mounted on the rod 506. A number of blades 508 are provided, equal to the maximum number of terminals in one side of a connector to be terminated in the machine 30, e.g., 25 blades 508 for machines adapted for use with connectors having up to 25 pairs of terminals. The blades 508 are spaced from one another by spacers 509 (see FIGS. 19 and 20B) at the same spacing as the ratchet teeth 332, see FIG. 21. Each of these blades is of a configuration as seen in FIG. 14, 20A and 20B, and includes an outwardly projecting step shoulder portion 508*a*, an outwardly projecting operating finger portion 508*b*, as well as alignment edge portions 508*c* and 508*d*. The later edge portions interdigitate with support ribs 510 extending upward from the top of block 330.

A series of generally Z-shaped spring-type latch/indicator levers 512 are provided as illustrated, there being one such element 512 for each of the blades 508. The elements 512 as shown are formed from a single generally Z-shaped plate which includes a unitary base portion 512*a* extending along the rear surface of the block 500 and held beneath a clamp bar 513. Each individual lever 512 includes a generally horizontal leg 512*b* extending from the base portion 512*a* and terminating in a detent latch portion 512*c*, with a vertical leg 512*d* extending from the detent section 512*c* to an upper end 512*e* which preferably is marked with a bright color contrasting with the rest of the machine for indicator purposes, as referred to below. The levers 512 are of spring material such that the detent section 512*c* cooperates with the latching shoulder 508*a* of the respective blade 508 to latch the blade either in a retracted position as in FIGS. 14 and 20A or in an extended "skip" or "reject" position as in FIGS. 20B, in accordance with a predetermined setting of the respective blade by the operator.

The blades 508 normally are in a retracted position as in FIGS. 14 and 20A. Means for selectively moving the blades 508 to the "reject" position includes a trip blade assembly 516 slidably mounted on a spline shaft 518. The shaft 518 is square in cross section and extends between the end plates 502 and 504 parallel to the shaft 506, and is journaled in the end plates. Referring particularly to FIG. 19A, the slide assembly 516 includes a slide block 520 having a pair of longitudinally-spaced laterally extending portions 522 and 524. Each of these portions is bifurcated to include upper and lower legs 522*a*, 522*b*, 524*a* and 524*b* which straddle the shaft 518 and fittingly engage the upper and lower flat surfaces. Retainer pins 526 in the outer ends of portions 522 and 524 retain the slide block 520 on the shaft 518. A detent latching ball 528 and compression spring 529 (FIG. 13) are provided in a central aperture 530 of the block 520, with the ball 528 projecting from the face of the block 520 adjacent the shaft 518, whereby the ball selectively engages a series of accurately positioned recesses 532 in that face of the shaft 518. A trip blade 534 is attached to the forward end of leg portion 524 by a screw 536. The blade 534 is generally C-shaped to extend from the area of attachment upwardly and inwardly over the shaft 518 to a terminal end 534*a* overlying the fingers 508*b* of the blades 508. The recesses 532 are accurately positioned such that with the detent ball 530 in one of these recesses, the trip blade 534 is in coplanar alignment with a selected one of the blades 508, whereby the end 534*a* overlies the respective operating finger 508*b* without overlying the fingers of adjacent blades 508.

A scale pointer 540 of generally I-configuration in cross section, as seen in FIG. 14, has slidable movement along a longitudinal slot 542 which is formed in the upper leg of a Z-shaped scale plate 544. The pointer 540 is bifurcated at its lower end to straddle the upper edge portion of the blade 534, as best seen in FIG. 19, for longitudinal movement with the assembly 516. The scale plate 544 is supported on upward shoulders of the end plates 502 and 504, as by screws 546. This plate is formed with a relatively large opening 548 in its central portion, through which the upper end portions 512*e* of the spring fingers are visible when in their upper positions as in FIGS. 14 and 20A.

An operating bar 550 is attached to the outer surface of block 520, as by screws 552, and carries an operating handle 554 at its forward end.

A reset bar 560 is provided of shallow U-shape, including an elongated bight portion 560*a* and a pair of end support leg portions 560*b* and 560*c* which engage the shaft 518 near its ends as seen in FIG. 19. These end portions are provided with square openings which fit the cross section of the shaft 518. Bar 560 also includes a lateral arm 560*d* (FIG. 13). A positioning spring 562 surrounds shaft 518 and has one arm engaging end plate 502 and another arm engaging the arm 560*d* for normally maintaining the slide assembly 516 in the centered position of its angular adjustment, as shown in FIG. 14. A spring washer 566 maintains accurate longitudinal positioning of the shaft 518.

In the operation of the programmer 120, the operator moves the slide assembly 516 longitudinally of the shaft 518 to the position of a blade 508 corresponding to a terminal position to be skipped. This position is indicated by alignment of the pointer 540 with suitable indicia on the scale plate 544. Final accurate alignment of the trip blade 534 with the proper reject blade 508 is assured by engagement of the detent ball 528 in the appropriate recess 532. With the slide assembly so positioned, the operator manipulates handle 554 to rotate the slide assembly counterclockwise as in FIG. 20B. This causes trip blade terminal end 534*a* to engage the respective finger 508*b* and thereby to rotate the respective plate 508 clockwise a sufficient amount to move the shoulder 508*a* past the detent portion 512*c* of the respective spring finger. The spring finger then holds the plate 508 in the "skip" or "reject" position of FIG. 20B. In this position the reject blade edge portion 508*c* is located between adjacent support ribs 510 and projects laterally into the path of a shoulder 570 on the index pawl 344. The blade 508 thus intercepts pawl 344 and thereby prevents engagement of the tooth 345 with the respective ratchet tooth 332, as at 332′ in FIG. 21, when the pawl 344 is released by lever 356 from its retracted position of FIG. 18C toward its normal ratchet engagement position. This intercepting or skip position is shown in solid lines in FIG. 21. Thereupon, when safety pawl 346 is retracted as in normal cycle operations described above, the carriage assembly will continue to advance by the force of motor 92 until the shoulder 570 clears the respective blade 508, as at the phantom line position shown in FIG. 21, whereupon the pawl 344 drops into position for engagement of the tooth 345 with the next ratchet tooth 332, as at 332″ in FIG. 21. This results in skipping of one termination position.

The latching movement of each spring finger element on a blade 508 in the skip or reject position causes the indicator tip 512*e* to move out of its normal alignment and out of normal line-of-sight through opening 546, thereby providing convenient indication to the operator as to which positions have been set for skipping.

Any number or combination of the blades 508 may be preset for skipping the respective positions during a full cycle of the termination of a set of wires in a connector. When the operator desires to reset the programmer, the handle is manipulated to rotate the slide assenbly 516 and the reset bar 560 clockwise as in FIG. 20A. Bar 560 thereby engages the fingers 508*b* of all blades 508 previously in the skip position and simultaneously rotates all of those blades back to their normal retracted position, as in FIG. 20A. In this position of the blades 508, edge portions 508*d* are disposed between the lateral support ribs 510. Also, the spring finger detents 512*c* are engaged over shoulders 508*a* to retain the blades 508 in this position, and indicator ends 512*e* are re-aligned in opening 548.

Figure 25:
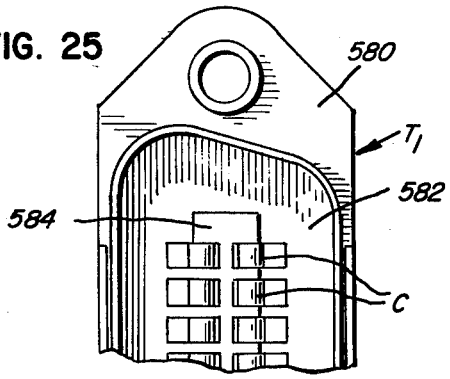
FIGS. 25 and 26 are partial plan views of portions of male and female connectors which engage the nest of FIGS. 23 and 24, respectively.
Figure 26:
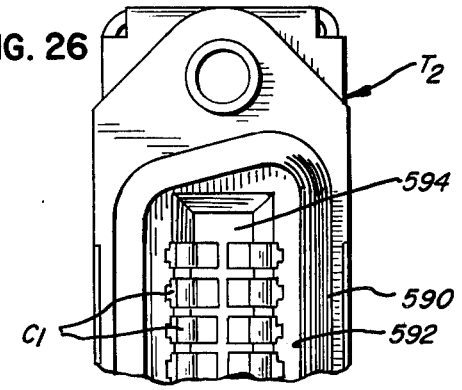

A variety of particular nests or holding devices may be utilized for properly positioning and securing various connectors on the carriage. The nest 52 described above is suitable for one type of connector. FIGS. 23–24 and 27 illustrate a universal nest 600 which is readily convertible for holding both male and female connectors, such as the connector T referred to above and further shown in part in FIGS. 25 and 26, respectively. The male connecto $T_1$ of FIG. 25 includes a metal jacket 580 surrounding a plastic body 582 which includes a center pedestal 584 (extending toward the viewer in FIG. 25) along which contactor portions C of the terminals are arrayed. The pedestal structure is on the opposite side of the connector $T_1$ from the terminal portion referred to above and into which the wires W are inserted, see FIG. 23. Thus the pedestal structure is downwardly disposed on a nest when the connector is mounted for termination operations. The plastic tongue or pedestal 584 is accurately dimensioned. Referring now to FIG. 26, the corresponding portions of a female connector $T_2$ include an outer jacket 590 which surrounds a portion of the molded plastic body 592 which also extends upwardly, i.e., toward the viewer as seen in FIG. 26. The portion 592 is formed with a generally rectangular recess 594, with the contacts $C_1$ being arrayed along the outer walls of this opening. The molded plastic body 592, including the recess 594, also is accurately dimensioned. The connectors $T_1$ and $T_2$ are of complementary designs for receiving the pedestal 584 and contacts C of connector $T_1$ in the recess 594 of the connector $T_2$ and with the contacts C and $C_1$ in registry and in electrically conductive contact with one another.

The nest 600 shown in FIGS. 23, 24 and 27 is adapted to receive and accurately position both male and female connectors such as the connectors $T_1$ and $T_2$. The connector 600 includes a main body section 602 formed with a pair of recesses 604*a* and 604*b* for receiving a pair of rockers 606*a* and 606*b*. The rockers are disposed in the recesses as illustrated, and are pivotally mounted on pins 608*a* and 608*b*. Each rocker includes a leg 610 of a post configuration for engaging in one end of a recess 594, and a second leg 612 of a channel shaped design to fit about and closely engage one end of a pedestal 584 within the surrounding jacket 580. The two legs 610 and 612 are disposed at right angles to one another. The rockers pivot between a first or male receiving position as in FIG. 23 where the legs 612 are in upright mutually inwardly facing relation to one another and the legs 610 extend outwardly and rest on support shoulders 616*a* and 616*b* of the body 602 to limit the outward movement of legs 612. In the alternative position of FIG. 24, the legs 610 project upwardly in mutually outwardly facing relation to one another, and the legs 612 rest on shoulders 618*a* and 618*b* of the body 602 to limit the relative inward movement of the legs 610. The rockers and respective posts and the support shoulders are so located that when the rockers are in the position of FIG. 23, the channels in post 612 closely and firmly engage the ends of the pedestal 584 for accurately positioning connectors $T_1$ longitudinally and laterally of the nest. Similarly, when the rockers are in a position of FIG. 24, the posts 610 engage in the ends of recess 594 with the outer faces of the posts closely and firmly engaging the end walls of the recess 594 for accurately positioning the connector $T_2$ longitudinally and laterally of the nest.

Referring now also to FIG. 27, each of the rockers 606 includes downwardly projecting operating lobes 624 within the lower portion of the respective recess 604. A rocker actuator 626 is pivotally mounted on a screw 628 at one end of the body 602, being retained by an actuator retainer washer 630. The drive lobe 624 of rocker 606*a* is connected to one side of the actuator 626 by a connecting rod 632. The drive lobe 624 of rocker 606*b* is connected to the opposite side of the actuator by a connecting rod 634. Because of the connection of the connecting rods to the actuator on opposite sides of its pivot axis, it will be appreciated that pivoting of one of the rockers 606 in one direction will cause concomitant pivoting of the other rocker 606 in the opposite direction. Thereby the two rockers may be simultaneously changed between the positions of FIGS. 23 and 24 by the operator simply by flipping one of the rockers to the desired position for quick adaptation of the machine 30 as between termination of male and female connectors. The connecting rods 632 and 634 are disposed in channel shaped recesses 633 and 635, respectively, which are provided in the body 602. A toggle spring 640 is connected between a portion of the housing 602 and a lobe 642 of the actuator for overcenter or snap action positioning of the actuator and thus of the two rockers between their two operative positions.

A pivot post 644 extends upward at one end of the body 602 and carries a pivotally mounted clamp or latch element 646 which is movable between an open position as shown in phantom lines in FIG. 23 and a closed or latched position as shown in solid lines in FIGS. 23 and 24. A toggle spring 648 provides overcenter or snap actuation holding of the latch 646 in these two end positions. The post 644 and latch 646 correspond generally to the post 148 and pivot clamp 146 of the nest 52. The movable end of the clamp overlies a flange of the jacket 580 and 590 at the outer end of connector $T_1$ and $T_2$, in the area indicated at 630 in FIG. 23, to lock the connectors on the nest.

Referring again to FIG. 27 each nest body 602 is formed with bosses or keys, as at 652*a*, 652*b* and 652*c* for registry with appropriate recesses in the carriage 304 for properly locating the nest on the carriage. An opening 654 is provided, with a counterbore forming a shoulder at 656 to receive an attachment screw 142 for securing each nest to the carriage. Thus it will be appreciated that a nest may be removed and replaced simply by removing one screw.

A connector T is secured on the nest 600 simply by flipping the rockers to the appropriate position, opening latch 646 and seating the connector on the upstanding rocker legs, then closing latch 646. The mounted connector thereby is accurately positioned longitudinally as well as laterally of the nest, and is locked in position by the latch 646. The nest body is of appropriate height for vertical alignment of the terminals with the termination mechanism. The nest 600 accommodates the male and female connectors of both TRW Inc. and Bunker Ramo Corporation referred to above.

Figure 28:
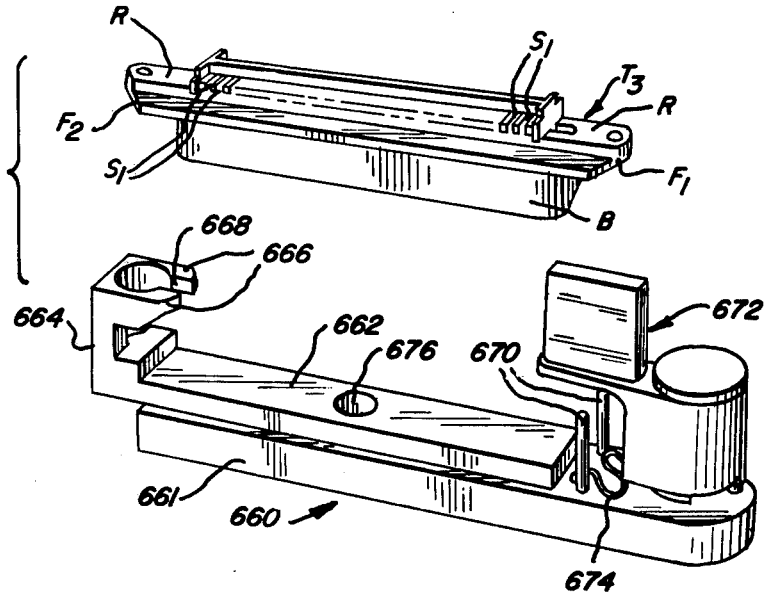
FIG. 28 is a perspective view of another universal nest for use on the machine of FIG. 1 to receive and hold male and female connectors of another design.

FIG. 28 illustrates another universal nest 600, particularly adapted to receive and hold both male and female connectors of the "AMP CHAMP" design referred to above. Such a connector is illustrated generally at $T_3$ in FIG. 28. The connector $T_3$ includes flanges $F_1$ and $F_2$ projecting from opposite ends, and each having a central rib or ridge R. The terminals are located in laterally open slots $S_1$, and the contacts for mating with another connector are disposed within body portion B.

The body 661 of nest 660 includes a raised central portion 662 for supporting a connector $T_3$ on the carriage 304 at the appropriate height for registry of the terminals with the ram end 184. At one end, the nest body is formed with a generally C-shaped portion 644 having a pair of spaced legs 666 extending inwardly and defining a slot 688 therebetween. A pair of spaced posts 670 are disposed at the opposite end. Adjacent the posts 670 is a pivotally mounted clamp or latch 672 which corresponds to the latches 146 and 646 referred to above. A toggle spring 674 also assists in holding the latch 672 in its retracted and in its latched positions. The nest body 661 is formed with bosses or keys on its underside and with a central opening 676 for mounting on the carriage in the same manner as nests 52 and 600.

In positioning a connector $T_3$ on the nest 660, the latch 672 is first opened. The appropriate end of the connector is then positioned with the respective flange $F_2$ extending beneath the arms 666 and with the respective rib R in registry with the space 668. The opposite end of the connector is then pressed downward, with the upper portions of posts 670 closely engaging the end edges of the flange $F_1$ whereby the connector is accurately positioned longitudinally as well as laterally of the nest. The latch 672 is then pivoted to the closed position of FIG. 28 in which the latch arm overlies the ridge R of the flange $F_1$, thereby locking the connector in position on the nest.

The operation and many of the advantages of machine 30 are believed to be clear from the foregoing. However, in summary, with the electric power and air supply connected and "on", the operator positions and latches a connector on a nest 52 with the carriage retracted as in FIGS. 1 and 3. A cable is positioned in the holder 50. The carriage is then drawn forward until the pawl controls are tripped. The carriage then is held by the index pawl in position for termination of wires in the first pair of terminals. The wires may be "fanned" as in FIG. 4 for convenience. The operator then selects the appropriate wires for the first terminals and dresses them downward in the wire trapping pockets as in FIG. 4 by swinging the wires forward, then downward and rearward (away from the operator) into the open pockets P and against the wire positioning stops and against tabs **264*b* whereby both switches 82*a* and 82*b*,** which are connected in series, are closed to automatically actuate the drive means for the wire insertion mechanism.

The aligned wires than are trimmed and inserted in the respective terminals as described in detail above with reference to the insertion assemblies. It should be noted particularly that each wire portion to be inserted first is precisely located in the same reference position and then is positively held with its axis parallel to the axis of the receiving terminal and is moved in a direction normal to its axis throughout the termination. This control of the wires during transference permits transfer over considerable distances as noted earlier, which permits wide spacing of the knife plates to accommodate a variety of connectors therebetween. The lateral controls of the wires also insures accurate alignment of the wires with the blades 180 and permits use of narrow insertion blades adapted to enter the terminals. Further, the accurate positioning and control of each wire insures that the wires are uniformly severed to the appropriate length and that severance is accomplished with a minimum of effort, and further assures that the wires are accurately and uniformly positioned in the terminals. Random angular orientation of the wires prior to severance is avoided, to insure uniform lengths of the termination portions and clean severance. Tilting of the wire inserts after severance also is avoided, which avoids a so-called "high wire" problem that otherwise can occur if the insertion portion tilts during transfer such that the distal end enters the terminal ahead of the balance of the insertion portion. The result is accurate reliable termination of wires in the connectors, and the capability to provide such results in a variety of connectors.

If only one wire is to be terminated, that wire is positioned as described and the operator simultaneously closes the opposite space control button 62 to override the respective switch 82 and obtain cycling of the machine. Similarly, the machine may be cycled by pressing both control buttons 42, as for skipping a pair of terminals or for inspection purposes. Skipping of preselected terminals is effected conveniently and automatically by appropriate setting of the programmer. The programmer of course may be omitted if this automatic skipping capability is not desired.

After the last wires are terminated in a connector, the carriage is released from the pawls and automatically moves to its retracted position where the pawl controls are actuated to set the control means for the next termination operation.

It will be noted that all of the wire positioning mechanisms are located outwardly of the path of travel of the connector and of the wires which are located over a connector when terminated. No wire positioning mechanism extends into the path of the terminated wires, which extend over the connector from the cable at the clamp and into the respective open upper ends of the terminal. Thus the connector and carriage may be advanced or retracted at the operator's wish any time during a termination operation. The carriage is released for such movement simply by disengaging the index pawl, as by pressing release button 44.

It will be seen that improved wire insertion apparatus has been provided which meets the aforestated objects.

It will be obvious that modifications of the specific embodiment shown and described may be made, beyond those noted in the description, without departing from the spirit and scope of the invention. By way of further examples, and without limitation, an open tray or shallow channel may be supported on the carriage and extend rearward from the cable clamp over the housing for receiving and carrying the end portion of the cable and/or other connectors such as when terminating wires of so-called booted cable. Such a tray may be located in the trough between the sections **34*a* and 34*b* and will reciprocate with the carriage. Other styles of cable clamps may be utilized, such as of lower profiles, to accommodate the particular work situations encountered. Varius drive means also may be utilized for the insertion mechanisms, such as mechanical or hydraulic, and a single drive may be used for operating both insertion assemblies, such as by using a single drive cylinder at 64***a* with appropriate drive linkages extending to the crank 66*b*.

While particular embodiments of this invention are shown and/or described, it will be understood, of course, that the invention is not to be limited thereto, since many modifications may be made by those skilled in the art, particularly in light of the teachings herein. It is contemplated, therefore, by the appended claims, to cover any such modifications as fall within the true spirit and scope of this invention.

What is claimed is:

1. In apparatus for successively terminating individual conductor wires of a group of such wires in separate laterally open parallel terminals distributed along the length of a connector by movement of each wire along a first path generally transversely of its longitudinal axis into a respective terminal of the connector, and including means for holding a connector, means for supporting a group of wires adjacent said connector, and wire stop means disposed opposite an open side of said terminals of a connector on said holding means for engaging a portion of a wire extending from said supporting means as said portion of said wire is moved transversely of said first path and locating a portion of such wire positioned thereagainst on said path, said apparatus providing an access passage to said stop means which is open from one side of said first path to permit said portion of each successive wire to be positioned against said stop means by movement of each successive wire transversely of its longitudinal axis and of said first path, the improvement comprising said stop means comprising wire stops located to orient such a wire portion positioned thereagainst in a first position on said path with the longitudinal axis of said portion substantially parallel to the axis of one of said terminals in said connector and with said portion in spaced relation to the connector, and means for transferring said wire portion from said first position into the respective terminal along said path while maintaining such parallel relationship.

2. Apparatus as in claim 1 wherein said wire stops include a first stop extending across said path between said first position and said holding means whereby the end of said wire portion nearest said supporting means engages said first stop.

3. Apparatus as in claim 2 wherein said first stop is retractable from its position across said path to permit movement of said wire portion along said path from said first position to said terminal.

4. Apparatus as in claim 2 including a knife element extending across said path between said first position and said holding means, and means cooperating with said knife element to sever a wire as said transferring means transfers a wire portion to the respective terminal.

5. Apparatus as in claim 4 wherein said cooperating means is a portion of said transferring means.

6. Apparatus as in claim 4 wherein said knife element and said first stop are aligned with one another parallel to the axis of said one of said terminals.

7. Apparatus as in claim 6 wherein said transferring means includes means for laterally supporting a wire portion during the transfer thereof from said first position to the respective terminal.

8. Apparatus as in claim 1 wherein said wire stops include a first stop extending across said path between said first position and said holding means and a second stop extending parallel to said path, said first and second stops being disposed to be engaged by such a wire at the end of said wire portion nearest said supporting means.

9. Apparatus as in claim 1 wherein said transfer means includes gripper means for gripping said wire portion and holding said wire portion against axial movement during movement thereof from said first position to said terminal, and means for abutting and pushing on said wire portion both above and below said gripper means during such transferring movement.

10. Apparatus as in claim 9 wherein said abutting and pushing means comprises an insertion blade having a leading end extending above and below said gripper means.

11. Apparatus for successively inserting individual conductor wires of a group of such wires in separate parallel terminals distributed along the length of a connector by movement of each wire along a first path generally transversely of its longitudinal axis into a respective terminal of the connector, and wherein each of said terminals is open to one side and to the top of the connector for receiving such wires therein, comprising: means for holding a connector; means for supporting a group of wires adjacent said top of said connector; wire locating means disposed on said one side of a connector on said holding means and in spaced relation to said connector, said wire locating means including wire stops disposed for engaging a portion of a wire extending from said supporting means as said portion of said wire is moved transversely of its said first path, said wire locating means providing an access passage to said stops which is open from one side of said first path to permit said portion of each successive wire to be positioned against said stops by movement of each successive wire transversely of its longitudinal axis and of said first path, said stops being located to orient such a wire portion positioned thereagainst in a first position on said path and spaced from said one side of said connector and with the longitudinal axis of said portion substantially parallel to the axis of one of said terminals in said connector; and means for transferring said wire portion from said first position into the respective terminal along said path while maintaining such parallel relationship.

12. Apparatus as in claim 11 wherein said wire stops include a first stop disposed above the level of the top of a connector on said holding means and extending across said path between said first position and said holding means whereby the end of said wire portion nearest said supporting means engages said first stop.

13. Apparatus as in claim 12 wherein said first stop is retractable from its position across said path to permit movement of said wire portion along said path from said first position to said terminal.

14. Apparatus as in claim 11 wherein said wire stops include a first stop extending across said path between said first position and said holding means, and a second stop generally parallel to said path and adjacent to said first position, both of said stops being disposed above the level of the top of a connector on said holding means whereby the end of said wire portion nearest said supporting means engages said stops.

15. Apparatus as in claim 14 wherein said supporting means is disposed adjacent one end of said connector, said second stop being on the same side of said path as said supporting means, and said wire locating means providing said access passage to said second stop outward of said first stop relative to said connector, said passage permitting movement of a wire through said passage to said second stop outward of said first stop.

16. Apparatus as in claim 15 including a knife element extending across said path beneath said first stop and having a knife edge opposite the lower end portion of said terminal, and means cooperating with said knife element to sever a wire as said transferring means transfers a wire portion to the respective terminal.

17. Apparatus for successively inserting individual conductor wires of a group of such wires in separate parallel terminals distributed along the length of a connector by movement of each wire along a first path generally transversely of its longitudinal axis into a respective terminal of the connector, and wherein each of said terminals is open to one side and to the top of the connector for receiving such wires therein, comprising: means for holding a connector; means for supporting a group of wires adjacent one end of said top of a connector on said holding means; wire locating means disposed on said one side of a connector on said holding means for positioning wires on said path; and means for moving said connector to align selected terminals thereof with said locating means; said wire locating means including a first wire stop extending across said path, a fixed wire stop adjacent said path and on the same side of said path as said supporting means, each of said wire stops being disposed above the level of the top of said connector and spaced outwardly from said one side of said connector whereby the area over said top of said connector is unobstructed and whereby a wire extending from said supporting means and disposed outward of said first stop and over said fixed stop and thereafter drawn downward will be maintained in spaced relation to said one side of said connector and a portion of said wire beneath said stops will be located in a first position on said path; and means for transferring said wire portion from said first position into the respective terminal.

18. Apparatus as in claim 17 wherein said first wire stop is movable to release a wire in said first position for transferring movement to the respective terminal.

19. Apparatus as in claim 17 wherein said first wire stop is retractable beneath said fixed wire stop to release a wire in said first position for transferring movement to the respective terminal.

20. Apparatus as in claim 17 wherein said wire locating means includes further wire stops disposed such that a wire portion positioned against said first, said fixed and said further wire stops is oriented substantially parallel to the axis of the respective terminal, and said transferring means including means for maintaining such parallel relationship of said wire portion to said terminal during such transferring movement.

21. Apparatus as in claim 20 wherein said further wire stops include a knife element extending across said path beneath said first stop and having a knife edge opposite the lower end portion of said terminal, and means cooperating with said knife element to sever a wire as said transferring means transfers a wire portion to the respective terminal.

22. Apparatus as in claim 21 wherein said transferring means includes movable means for laterally supporting said wire portion and which is reciprocable along said first path toward and away from a connector on said holding means between a retracted position, to facilitate movement of such a wire portion against said fixed stop outward of said first stop, and an extended position for engaging and supporting said wire portion.

23. Apparatus as in claim 22 wherein said movable means defines a guide channel extending on opposite sides of said wire portion.

24. Apparatus as in claim 23 wherein said transferring means includes an insertion element which is reciprocable within said guide channel for pushing said wire portion along said path and into the respective terminal.

25. Apparatus for successively inserting individual conductor wires of a group of such wires in separate parallel terminals distributed along the length of a connector by movement of each wire along a first path generally transversely of its longitudinal axis into a respective terminal of the connector, and wherein each of said terminals is open to one side of the connector for receiving such wires therein, comprising: means for holding a connector; means for supporting a group of wires adjacent said connector; wire locating means for positioning a portion of one of said wires on said path in a first position spaced outward from said side of said connector; means for laterally supporting said wire portion as it is moved from said first position into the respective terminal; insertion means movable along said path for moving said wire portion from said first position into such an aligned terminal while said wire portion is laterally supported by said supporting means; and means for selectively controlling the extent of inward movement of said insertion means to accommodate seating of such wire portions in connectors and terminals of various designs.

26. Apparatus as in claim 25 wherein said means for laterally supporting said wire portion is movable along said path, and means for selectively controlling the extent of movement of said lateral supporting means toward said connector.

27. Apparatus as in claim 26 wherein said insertion means and said means for laterally supporting said wire portion are reciprocable along said path, means for reciprocating each of said insertion means and said lateral supporting means, and wherein each of said controlling means comprises a selectively positionable stop for limiting the inward drive movement of the respective reciprocating means.

28. Apparatus as in claim 25 including severing means adjacent said first position and spaced outward from said holding means for trimming said wire portion.

29. Apparatus as in claim 28 wherein said severing means includes a knife element fixed adjacent said first position, said insertion means cooperating with said knife element for trimming said wire portion.

30. In apparatus for terminating individual conductor wires in laterally open parallel terminals of a connector by movement of each wire along a first path generally transversely of its longitudinal axis into the respective terminal of the connector, and including means for locating a portion of a wire in a first position on said path in spaced relation to one of said terminals, means for transferring said wire portion from said first position into the respective terminal along said path, said transferring means including gripper means for gripping said wire portion and holding said wire portion against axial movement during movement thereof from said first position to said terminal, and insertion means for abutting and pushing said wire portion during such transferring movement, the improvement wherein said insertion means engages and pushes said wire portion both above and below said gripper means.

31. Apparatus as in claim 30 wherein said gripper means comprises opposed gripper elements and said insertion means comprises an insertion blade extending between said gripper elements.

32. Apparatus for successively inserting individual conductor wires of a group of such wires in separate parallel terminals distributed along the length of a connector by movement of each wire along a first path generally transversely of its longitudinal axis into a respective terminal of the connector, and wherein each of said terminals is open to one side of the connector for receiving such wires therein, comprising: means for holding a connector; means for supporting a group of wires adjacent said connector; wire locating means for positioning a portion of one of said wires on said path in a first position spaced outward from said side of said connector, with the longitudinal axis of said portion substantially parallel to the axis of one of said terminals in said connector; means for laterally supporting said wire portion as it is moved from said first position into the respective terminal; insertion means movable along said path for moving said wire portion from said first position into such an aligned terminal while said wire portion is laterally supported by said supporting means and while maintaining such parallel relationship; and means for selectively controlling the extend of inward movement of said insertion means to accommodate seating of such wire portions in connectors and terminals of various designs.

33. Apparatus as in claim 32 including severing means adjacent said first position and spaced outward from said holding means for trimming said wire portion.

34. Apparatus as in claim 33 wherein said severing means includes a knife element fixed adjacent said first position, said insertion means cooperating with said knife element for trimming said wire portion.

* * * * *

UNITED STATES PATENT AND TRADEMARK OFFICE

CERTIFICATE OF CORRECTION

PATENT NO. : 4,034,472

DATED : July 12, 1977

INVENTOR(S) : William S. Cover, et al.

It is certified that error appears in the above-identified patent and that said Letters Patent are hereby corrected as shown below:

Col. 15, line 55, "365" should read -- 356 --. Col. 16, line 3, "nxt" should read -- next --. Col. 16, line 34, "simple" should read -- simply --. Col. 16, line 41, delete "in" (second occurrence). Col. 18, line 66, "assenbly" should read -- assembly --. Col. 19, line 16, "connecto" should read -- connector --. Col. 20, line 67, "600" should read -- 660 --. Col. 21, line 13, "644" should read -- 664 --. Col. 21, line 15, "688" should read -- 668 --. Col. 21, line 57, "than" should read -- then --. Col. 22, line 1, "controls" should read -- control --.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*